US010378120B2

(12) United States Patent
Kolberg et al.

(10) Patent No.: US 10,378,120 B2
(45) Date of Patent: Aug. 13, 2019

(54) METHOD FOR COATING METALLIC SURFACES WITH A MULTI-COMPONENT AQUEOUS COMPOSITION

(71) Applicant: Chemetall GmbH, Frankfurt am Main (DE)

(72) Inventors: Thomas Kolberg, Heppenheim (DE); Peter Schubach, Nidderau/Windecken (DE); Manfred Walter, Hanau (DE); Carola Komp, Mörfelden-Walldorf (DE); Michael Dröge, Frankfurt am Main (DE)

(73) Assignee: Chemetall GmbH, Frankfurt am Main (DE)

( * ) Notice: Subject to any disclaimer, the term of this patent is extended or adjusted under 35 U.S.C. 154(b) by 571 days.

(21) Appl. No.: 14/353,164

(22) PCT Filed: Oct. 23, 2012

(86) PCT No.: PCT/EP2012/070929
§ 371 (c)(1),
(2) Date: Apr. 21, 2014

(87) PCT Pub. No.: WO2013/060662
PCT Pub. Date: May 2, 2013

(65) Prior Publication Data

US 2014/0255706 A1 Sep. 11, 2014

(30) Foreign Application Priority Data

Oct. 24, 2011 (DE) ..... 10 2011 085 091

(51) Int. Cl.

| | |
|---|---|
| ***C25D 5/34*** | (2006.01) |
| ***C25D 5/36*** | (2006.01) |
| ***C25D 5/44*** | (2006.01) |
| ***C25D 13/20*** | (2006.01) |
| ***C23C 22/78*** | (2006.01) |
| ***C23C 22/80*** | (2006.01) |
| ***C23C 22/34*** | (2006.01) |
| ***C23C 22/83*** | (2006.01) |
| ***C23C 18/12*** | (2006.01) |

(52) U.S. Cl.
CPC ..... *C25D 13/20* (2013.01); *C23C 18/122* (2013.01); *C23C 18/1241* (2013.01); *C23C 22/34* (2013.01); *C23C 22/78* (2013.01); *C23C 22/80* (2013.01); *C23C 22/83* (2013.01); *C25D 5/34* (2013.01); *C25D 5/36* (2013.01); *C25D 5/44* (2013.01); *C23C 2222/20* (2013.01); *Y10T 428/31663* (2015.04)

(58) Field of Classification Search
CPC ..... C25D 5/34–44; C23C 22/78; C23C 22/80
See application file for complete search history.

(56) References Cited

U.S. PATENT DOCUMENTS

| | | | | |
|---|---|---|---|---|
| 3,620,949 | A | 11/1971 | Caulfield et al. | |
| 5,294,266 | A * | 3/1994 | Hauffe | C23C 22/34 148/243 |
| 6,346,295 | B1 | 2/2002 | Riesop et al. | |
| 8,182,874 | B2 | 5/2012 | Kolberg et al. | |
| 2004/0170840 | A1 | 9/2004 | Matsukawa et al. | |
| 2005/0109627 | A1 * | 5/2005 | Sun | C25D 3/38 205/115 |
| 2007/0298174 | A1 * | 12/2007 | Kolberg | C09D 5/08 427/352 |
| 2008/0127859 | A1 | 6/2008 | Kolberg et al. | |
| 2008/0280046 | A1 | 11/2008 | Bryden et al. | |
| 2010/0038250 | A1 | 2/2010 | Matsukawa et al. | |
| 2010/0243465 | A1 * | 9/2010 | Inbe | C09D 5/4488 205/184 |
| 2011/0086173 | A1 * | 4/2011 | Walter | C09D 4/00 427/397.7 |
| 2011/0094630 | A1 | 4/2011 | Yoshida et al. | |

FOREIGN PATENT DOCUMENTS

| | | | |
|---|---|---|---|
| DE | 2017327 | A1 | 1/1971 |
| DE | 10 2005 015 576 | A1 | 10/2006 |
| JP | 61-291997 | A | 12/1986 |
| JP | 10-046393 | A | 2/1998 |
| WO | 2006/050915 | A2 | 5/2006 |
| WO | 2011/098322 | A1 | 8/2011 |

* cited by examiner

*Primary Examiner* — Brian W Cohen
(74) *Attorney, Agent, or Firm* — Armstrong Teasdale LLP

(57) ABSTRACT

A method for coating metallic surfaces with aqueous compositions, wherein a silane-based aqueous composition containing at least one silane and/or a related silicon-containing compound and optionally additional components is treated further, for example, at temperatures above 70° C., in a pretreatment step without drying the coating, by using at least one aqueous rinse step after this pretreatment step and then performing an electrodeposition coating, in which at least one surfactant is added at least in the last rinse step of the aqueous rinse steps. Coated metallic surfaces are also described.

22 Claims, No Drawings

METHOD FOR COATING METALLIC SURFACES WITH A MULTI-COMPONENT AQUEOUS COMPOSITION

This application is a § 371 of International Application No. PCT/EP2012/070929 filed Oct. 23, 2012, and claims priority from German Patent Application No. 10 2011 085 091.0 filed Oct. 24, 2011.

A method for improving the throwing power of an electrodeposition coating by coating metallic surfaces with aqueous pretreatment compositions is described.

The invention relates to a method for coating metallic surfaces with aqueous compositions, wherein a silane-based aqueous composition containing at least one silane and/or a related silicon-containing compound and optionally additional components is treated further, for example, at temperatures above 70° C., in a pretreatment step without drying the coating, by using at least one aqueous rinse step after this pretreatment step and then performing an electrodeposition coating, in which at least one surfactant is added at least in the last rinse step of the aqueous rinse steps.

Previously, the most commonly used methods for treating metallic surfaces, in particular parts, coil or coil sections made of at least one metallic material and/or for pretreatment of metallic surfaces before painting of the metallic surfaces have often been based on the use of chromium(VI) compounds, on the one hand, optionally together with various additives, or phosphates, on the other hand, for example, zinc-manganese-nickel phosphates, optionally together with various additives.

For many years now, there has been a search for alternatives to these methods in all the fields of surface technology for metal substrates because of the toxicological and ecological risks associated with methods using chromate or nickel in particular, but it has nevertheless been found repeatedly that in many applications, completely chromate-free or nickel-free processes do not fulfill 100% of the performance spectrum or not with the desired certainty. Then an attempt is made to keep the chromate content and/or nickel content as low as possible, to replace $Cr^{6+}$ with $Cr^{3+}$ as much as possible. High-quality phosphating treatments, which have kept corrosion protection of automobiles at a high quality level, are in use in the automobile industry in particular, for example, for pretreatment of vehicle bodies before painting. Zinc-manganese-nickel phosphating treatments are usually used for this purpose. Despite many years of research and development, it has not yet been possible to develop methods for phosphating treatment for multimetal applications without the use of nickel and without any definite quality restrictions, as in the case of vehicle bodies, for example. In Europe, metallic surfaces of steel, galvanized steel and aluminum and/or aluminum alloys are typically treated in the same bath. In the foreseeable future, however, the nickel content, even if it is comparatively low, will have to be classified as more objectionable toxicologically, so the question arises as to whether equivalent corrosion protection can be achieved with other chemical processes.

In the automobile industry in particular, an electrodeposition coating using an electrodeposition paint, such as a cathodic electro-dip coating (CDC) is often used as the first paint layer in the automobile industry in particular. The compositions and use conditions in electrodeposition coating are fundamentally known.

The use of silanes/silanols, for example, in aqueous compositions to produce siloxane/polysiloxane-rich anticorrosion coatings is fundamentally known. For the sake of simplicity, when silane is mentioned below, it is understood to refer to silane/silanol/siloxane/polysiloxane. These coatings have proven successful, but the processes for coating with an aqueous composition containing primarily silane plus solvent(s) have proven to be difficult to use in some cases. These coatings are not always formed with excellent properties. Furthermore, there may be problems in being able to adequately characterize the very thin transparent silane coatings on the metallic substrate and their defects with the naked eye or with optical aids. The corrosion protection and the paint adhesion of the resulting siloxane-rich and/or polysiloxane-rich coatings are often, but not always, high and to some extent are not high enough for certain applications, even when applied suitably. Additional processes using at least one silane are needed to achieve high process reliability and a high quality of the coatings produced with them, in particular with regard to corrosion resistance and paint adhesion.

In the design of silane-based aqueous compositions, a small and/or large added quantity of at least one component selected from the group of organic monomers, oligomers and polymers has also proven successful. With such compositions, the type and quantity of silane added is of crucial importance for their success in some cases. However, the amounts of silane added for this purpose are usually comparatively low—in most cases only up to 5% by weight of the total solids contents—and then act as a "coupling agent," wherein the adhesion-promoting effect should prevail in particular between the metallic substrate and the paint and optionally between the pigment and the organic paint constituents, but a minor crosslinking effect may also occur to a lesser extent. Primarily very small amounts of silane additives are added to thermally curable resin systems.

When using silane-based solutions for coating metallic surfaces, it has been known in the past that solutions containing essentially or mainly silane and its derivatives are sensitive to water if the coatings have not been dried to a greater extent, so that a water rinsing of the freshly applied coatings, which have not yet dried thoroughly, will usually result in an impairment of the coatings, e.g., due to separation, because they are not sufficiently rinse-fast. Evidently the very thin oxide/hydroxide layers of the "natural" oxide films on metallic surfaces are not sufficient to adequately keep freshly applied silane adhering before it is dried thoroughly. These coatings are usually insensitive to water only when the coatings have been dried (for example, for 5 minutes at 80° C. PMT (peak metal temperature), e.g., 25 minutes at 70° C. PMT or higher) because condensation of the silanes/silanols/siloxanes/polysiloxanes will have already progressed to a greater extent. The degree of drying which is associated with condensation of the silanes/silanols/siloxanes/polysiloxanes and leads to a rinse-fastness of the siloxane/polysiloxane-containing coating is variable, depending on the phase, the coating and the type of rinsing.

Existing phosphating plants, in particular in the automotive industry, for cleaning and pretreatment of vehicle bodies before painting, for example, do not require a drying installation. However, such a channel-type installation is often more than 100 meters long even without such a drying installation. In many cases, such an installation is located in immediate proximity to an installation for coating by cathodic dip coating (CDC) at the end, where the completely phosphate vehicle bodies emerge from the channel, so that in most cases no room is available for the incorporation of a drying plant in addition.

When using electrodeposition coating after a silane-based pretreatment, there has been the problem in automotive engineering in particular of reducing the voltage of the electrodeposition coating in comparison with a process sequence that includes a zinc phosphate coating, because the comparatively thick zinc phosphate layers result in a much higher electric resistance in the electrodeposition bath. Due to the use of lower electric voltages in the electrodeposition bath with a comparatively thin silane-based pretreatment coating with a comparatively low electric resistance, there may be problems with evenness, uniformity and visual appearance of the applied electrodeposition coating as well as the throwing power of the paint, especially on undercut locations of metal parts having a complex shape.

When using electrodeposition coating after a silane-based pretreatment, there has been the problem of improving the quality of the electrodeposition coating in automotive engineering in particular, because in many situations the throwing power is inadequate in the case of workpieces and constructions with complex shapes such as housings and vehicle bodies, for example, to permit the most uniform possible layer thicknesses of the electrodeposition coating on the inside and outside and thereby also fulfill all the other quality requirements of the coating.

The object was therefore to propose a method for aqueous compositions whose coatings would have the most environmentally friendly chemical composition possible while ensuring a high corrosion resistance, which will be suitable even in multimetal applications in which, for example, steel and zinc-rich metallic surfaces and optionally also aluminum-rich metallic surfaces are treated or pretreated in the same bath. Another object was to propose a process sequence from pretreatment to electrodeposition coating in which high-quality coatings of the silane-based pretreatment and electrodeposition coating can be applied to vehicle bodies in mass production of automobiles with as little trouble as possible. Furthermore, another object was to propose a method using silane-based aqueous compositions that could fundamentally be implemented in existing plants in the automotive industry and would be suitable for coating vehicle bodies in automotive engineering in particular. A quality coating of pretreatment coating and electrodeposition coating on vehicle body surfaces is to be achieved here, such as that achieved with high-quality anticorrosion coatings in zinc-manganese-nickel phosphating treatments, so as not to endanger the quality standard.

It has now been found that adding at least one surfactant in the one rinse step in rinsing with water after the silane-based pretreatment or at least in the last of several rinse steps in rinsing with water after the silane-based treatment makes it possible to achieve a uniform electrodeposition coating, such that there is better throwing power of the electrodeposition paint and possibly also of the electric field in electrodeposition coating and the layer thicknesses of the electrodeposition coatings are significantly more uniform from the outside to the inside, for example, in the case of a housing or a vehicle body.

The addition of complex fluoride in the silane-based pretreatment helps to minimize and/or prevent impairment of the binding of silane to the metallic surface, so that rinsing can have little or no harmful effect. A combination of at least two complex fluorides in the silane-based pretreatment composition, in particular fluorotitanic acid and fluorozirconic acid and/or their salts, also permits an extraordinary increase in the quality of the coatings.

It has been found that it is not only possible to rinse freshly applied coatings, which are not yet fully dried and therefore have not yet undergone a higher degree of condensation in the case of coatings based on silane, but this process sequence is instead even advantageous because the pretreatment coatings produced and rinsed in this way have an even better anticorrosion effect and better paint adhesion, regardless of the chemical composition of the aqueous silane-based (=silane/silanol/siloxane/polysiloxane and/or silane/silanol/siloxane) pretreatment composition to some extent. This is in contradiction with previous experience, according to which rinsing of a freshly applied, not yet thoroughly dried coating based on silane often has a negative effect on the quality of the layer, if not partially, or in some cases even completely, removing the coating.

It has also been found that it is possible and advantageous to apply a paint such as an electrodeposition coating paint, a paint-like coating, a primer or an adhesive to freshly applied silane-based pretreatment coatings which have not yet dried completely and therefore have not yet fully condensed, but which have optionally also been rinsed in this condition. The application of such compositions to silane-based wet films is advantageous because the coatings produced and rinsed in this way even have a better anticorrosion effect and better paint adhesion in some cases, regardless of the chemical composition of the aqueous bath.

It has now been found that the use of an aqueous composition containing iron prior to applying the silane-based pretreatment composition permits an increased voltage to be used in electrodeposition coating. The voltage used here may often be 5% to 15% higher. It has been found here that the throwing power thereby obtained is improved by approx. 5% to 15% because of the higher voltage.

This object has been achieved with a method for improving the throwing power of an electrodeposition coating by coating metallic surfaces with a pretreatment composition containing silane/silanol/siloxane/polysiloxane, this composition also containing the following in addition to water and optionally in addition to at least one organic solvent and/or at least one substance to influence the pH:

a) at least one compound a) selected from silanes, silanols, siloxanes and polysiloxanes, wherein at least one of these compounds may still condense, and
b) at least one compound b) containing titanium, hafnium and/or zirconium as well as
c) at least one type of cation c) selected from cations of metals of auxiliary groups I to III and V to VIII, including lanthanides, as well as main group II of the periodic system of elements and/or at least one corresponding compound c) and/or
d) at least one organic compound d) selected from monomers, oligomers, polymers, copolymers and block copolymers, wherein the coating freshly applied with this composition is rinsed at least once with water, wherein at least one water rinse contains a surfactant, wherein an electrodeposition coating is applied after rinsing with water, and wherein the coating freshly applied with this composition is not dried thoroughly before this rinsing, so that the at least one condensable compound a) is not highly condensed before rinsing the pretreatment coating with water and/or before coating with an electrodeposition paint and/or wherein the pretreatment coating applied freshly with the pretreatment composition is not dried thoroughly before applying a subsequent electrodeposition coating, so that the at least one condensable compound a) is not highly condensed before the subsequent electrodeposition coating is applied.

The object of the present invention is also achieved with a method for improving the throwing power of an electrodeposition coating by coating metallic surfaces with a pretreatment composition containing silane/silanol/siloxane/polysiloxane, characterized in that this composition contains the following, in addition to water and optionally in addition to at least one organic solvent and/or at least one substance to influence the pH:

a) at least one compound a) selected from silanes, silanols, siloxanes and polysiloxanes, where at least one of these compounds can still condense further, and
b) at least one compound b) containing titanium, hafnium and/or zirconium as well as
c) at least one type of cation c) selected from cations of metals of auxiliary groups I to III and V to VIII, including lanthanides, as well as main group II of the periodic system of elements and/or at least one corresponding compound c) and/or
d) at least one organic compound d) selected from monomers, oligomers, polymers, copolymers and block copolymers, wherein the coating applied freshly with the pretreatment composition is rinsed at least once with water, wherein optionally at least one water rinsing has a surfactant content, and wherein an electrodeposition coating is applied after rinsing with water, wherein the coating freshly applied with this composition is not dried thoroughly before this rinsing, so that the at least one condensable compound a) is not greatly condensed before rinsing the pretreatment coating with water and/or before coating with an electrodeposition coating and/or wherein the pretreatment coating freshly applied with the pretreatment composition is not dried thoroughly before applying a subsequent electrodeposition coating, so that the at least one condensable compound a) is not highly condensed before applying the subsequent electrodeposition coating, and wherein an aqueous treatment with a water-dissolved iron compound content is performed before the treatment with an aqueous silane-based pretreatment composition.

This object is also achieved by using an aqueous silane-based pretreatment composition in a coating method for metallic substrates for improving the throwing power of an electrodeposition coating, in which an aqueous silane-based composition is brought in contact with a metallic substrate, wherein the coating applied freshly with this composition is rinsed at least once with water, wherein the rinsing is performed at least once with water containing a surfactant, in which an electrodeposition coating is applied after rinsing with water, and the coating applied freshly with this composition is not dried thoroughly before this rinsing, so that the at least one condensable compound a) does not condense to a great extent before rinsing the pretreatment coating with water and/or before coating with an electrodeposition paint.

Finally, this object is achieved with the use of an aqueous silane-based pretreatment composition in a coating method for metallic substrates for improving the throwing power of an electrodeposition coating, wherein the substrates are brought in contact at least once with an aqueous composition containing iron before the aqueous silane-based pretreatment, wherein an aqueous silane-based composition is brought in contact with a metallic substrate, wherein the coating applied freshly with this composition is rinsed at least once with water, wherein optionally the rinsing is performed at least once with water containing a surfactant, wherein after rinsing with water an electrodeposition coating is applied, wherein the pretreatment coating applied freshly with the pretreatment composition is not dried thoroughly before applying a subsequent electrodeposition coating, so that the at least one condensable compound a) does not condense to a great extent before applying the subsequent electrodeposition coating.

In one embodiment, a second conversion layer and/or a coating may also be used in the middle of this process sequence as a result of application of an after-rinse solution. The second conversion layer or the coating due to application of an after-rinse solution is preferably an aqueous composition based on at least one silane/silanol/siloxane/polysiloxane, of at least one compound containing titanium, hafnium, zirconium, aluminum and/or boron such as, for example, at least one complex fluoride, at least one organic compound selected from monomers, oligomers, polymers, copolymers and block copolymers and/or at least one compound containing phosphorus and oxygen. In many embodiment variants, the concentration of the aqueous composition for the second conversion layer and/or the after-rinse solution is lower on the whole than a comparable aqueous composition for the first conversion layer, namely the silane-based pretreatment coating according to the invention.

It is particularly advantageous when the freshly applied coating is rinsed first with water or with an aqueous solution before a subsequent coating is applied. The wet film of the silane-based pretreatment according to the invention may be rinsed here with water and/or with an aqueous composition optionally containing a surfactant without prior greater drying of the wet film with water. Then without having dried the film to a greater extent, a subsequent coating is applied to this wet film. The wet film is then rinsed after the silane pretreatment, preferably immediately after the coating with the aqueous composition containing silane, in particular within one or two minutes after coating with the silane pretreatment according to the invention, especially preferably within 30 seconds or even within 10 seconds after this coating. If several water rinses are used, it is preferable for at least the last of these water rinses to contain at least one surfactant. The electrodeposition paint is preferably applied immediately after rinsing, in particular within two or three minutes after rinsing the silane-based pretreatment coating, especially preferably within 60 seconds or even within 20 seconds. The paint here may be in particular an electrodeposition paint or a water-based wet paint. On the other hand, it may frequently happen, in particular in industrial manufacturing, that the period of time from the end of rinsing with water until applying the electrodeposition coating is 1 to 120 minutes, but preferably only 2 to 60 minutes or 3 to 40 minutes or 4 to 20 minutes, because it is advantageous if, despite this waiting time, greater drying of the rinsed silane-based pretreatment coating does not occur. It may be advantageous here to take measures, so that the rinsed silane-based pretreatment coatings do not dry out thoroughly and preferably do not even dry out to a greater extent, for example, through the use of a wettening system such as nozzles for spraying a water mist, for example.

It is assumed that the at least one silane/silanol/siloxane that is still condensable is still highly reactive chemically and can react more intensely with the electrodeposition paint applied subsequently than a silane/silanol/siloxane/polysiloxane that is already thoroughly dried and highly condensed under the influence of temperature. It is assumed that it will still be reactive after a waiting period of up to several hours after rinsing, as long as a temperature of more than 40°

C., for example, is not employed, which would lead to a thorough drying of the silane-based pretreatment coating.

The term "silane" is used here to stand for silanes, silanols, siloxanes, polysiloxanes and their reaction products and/or derivatives which are often "silane" mixtures. The term "condense" in the sense of this patent application refers to all forms of crosslinking, further crosslinking and further chemical reactions of the silanes/silanols/siloxanes/polysiloxanes. Addition in the form of a silane is usually assumed here, where the at least one silane added is often at least partially hydrolyzed, usually forming at least one silanol on initial contact with water or humidity, at least one siloxane being formed from the silanol and later optionally also at least one polysiloxane (possibly) being formed. The term "coating" in the sense of the patent application relates to the coating formed with the aqueous composition including the wet film, the partially dried film, the thoroughly dried film, the film dried at an elevated temperature and the film further crosslinked, optionally by thermal and/or radiation treatment.

The aqueous silane-based pretreatment composition is an aqueous solution, an aqueous dispersion and/or an emulsion. Its pH is preferably greater than 1.5 and less than 9, especially preferably in the range of 2 to 7, most especially preferably in the range of 2.5 to 6.5, in particular in the range of 3 to 6. At a high pH of 2.5, for example, a greatly reduced separation of titanium and/or zirconium compounds may occur, for example, from the complex fluoride, which may have effects due to a slight reduction in the layer properties. At a pH of approx. 7, the complex fluoride present in the bath may become unstable and may form precipitates.

At least one silane and/or at least one corresponding compound with at least one amino group, with at least one urea group and/or with at least one ureido group (imino group) is especially preferably added to the aqueous silane-based pretreatment composition because the coatings produced in this way often have a greater paint adhesion and/or a higher affinity for the following electrodeposition coating. In particular in use of at least one silane and/or at least one corresponding compound with at least one such group, it is important to note that condensation may proceed very rapidly at a pH of less than 2. The amount of aminosilanes, ureidosilanes and/or silanes with at least one urea group and/or corresponding silanols, siloxanes and polysiloxanes in the total of all types of compounds, selected from silanes, silanols, siloxanes and polysiloxanes, may be elevated, especially preferably more than 20% by weight, more than 30% or more than 40% by weight, calculated as the corresponding silanols, most especially preferably more than 50%, more than 60%, more than 70% or more than 80% by weight and optionally even up to 90% by weight, up to 95% or up to 100% by weight.

The aqueous silane-based pretreatment composition preferably has a silane/silanol/siloxane/polysiloxane content a) in the range of 0.005 to 80 g/L, calculated on the basis of the corresponding silanols. This content is especially preferably in the range of 0.01 to 30 g/L, most especially preferably in the range of 0.02 to 12 g/L, up to 8 g/L or up to 5 g/L, in particular in the range of 0.05 to 3 g/L or in the range of 0.08 to 2 g/L or up to 1 g/L. These content ranges refer to bath compositions in particular.

However, if a concentrate is used to prepare a corresponding bath composition, in particular by diluting with water and optionally adding at least one additional substance, it is advisable to keep a concentrate A, which contains silane/silanol/siloxane/polysiloxane a) separately from a concentrate B, which contains all or almost all the other components and not to combine these components until they are in the bath. Optionally at least one silane, silanol, siloxane and/or polysiloxane may also be present partially or entirely in solid form, added in solid form and/or added as a dispersion or solution. However, the concentration ranges of the bath may also emphasize different contents, depending on the application.

The aqueous silane-based pretreatment composition especially preferably contains at least one silane, silanol, siloxane and/or polysiloxane a), each with at least one group selected from acrylate groups, amino groups, succinic acid and hydride groups, carboxyl groups, epoxy groups, glycidoxy groups, hydroxy groups, ureido groups (imino groups), isocyanato groups, methacrylate groups and/or urea groups per molecule, wherein aminoalkyl groups, alkylaminoalkyl groups and/or alkylamino groups may also occur. This composition especially preferably contains at least one silane, silanol, siloxane and/or polysiloxane a) with at least two amino groups, with at least three amino groups, with at least four amino groups, with at least five amino groups and/or with at least six amino groups per molecule.

The silanes, silanols, siloxanes and/or polysiloxanes in the aqueous silane-based pretreatment composition or at least their compounds added initially to the aqueous composition or at least some of them are preferably water-soluble. The silanes in the sense of this patent application are regarded as being water soluble if they have a water solubility of at least 0.05 g/L, preferably at least 0.1 g/L, especially preferably at least 0.2 g/L or at least 0.3 g/L, in general at room temperature in the composition containing silane, silanol, siloxane and/or polysiloxane. This does not mean that each individual one of these silanes must have this minimum solubility but rather that these minimum values are achieved on the average.

Preferably at least one silane, silanol, siloxane, polysiloxane is present in the aqueous silane-based pretreatment composition, selected from fluorine-free silanes and the corresponding silanols, siloxanes, polysiloxanes, each from at least one acyloxy silane, an alkoxysilane, a silane having at least one amino group such as an aminoalkyl silane, a silane having at least one succinic acid group and/or succinic anhydride group, a bis(silyl)silane, a silane having at least one epoxy group such as a glycidoxy silane, a (meth)acrylate silane, a multisilyl silane, a ureido silane, a vinyl silane and/or at least one silanol and/or at least one siloxane and/or polysiloxane of a corresponding chemical composition, such as that of the silanes described above. It contains at least one silane and/or (respectively) at least one monomeric, dimeric, oligomeric and/or polymeric silanol and/or (respectively) at least one monomeric, dimeric, oligomeric and/or polymeric siloxane, wherein oligomers as referenced below should also include dimers and trimers. The at least one silane and/or the corresponding silanol/siloxane/polysiloxane especially preferably has at least one amino group, urea group and/or ureido group.

In particular at least one silane and/or at least one corresponding silanol/siloxane/polysiloxane is present herein and/or initially added, selected from the group and/or based on (3,4-epoxyalkyl)trialkoxysilane,
(3,4-epoxycycloalkyl)alkyltrialkoxysilane,
3-acryloxyalkyltrialkoxysilane,
3-glycidoxyalkyltrialkoxysilane,
3-methacryloxyalkyltrialkoxysilane,
3-(trialkoxysilyl)alkylsuccinic acid silane,
4-aminodialkylalkyltrialkoxysilane,
4-aminodialkylalkylalkyldialkoxysilane, aminoalkylaminoalkyltrialkoxysilane,
aminoalkylaminoalkylalkyldialkoxysilane,
aminoalkyltrialkoxysilane,
bis(trialkoxysilylalkyl)amine,
bis(trialkoxysilyl)ethane,
γ-acryloxyalkyltrialkoxysilane,
γ-aminoalkyltrialkoxysilane,
γ-methacryloxyalkyltrialkoxysilane,
(γ-trialkoxysilylalkyl)dialkylenetriamine,
γ-ureidoalkyltrialkoxysilane,
N-2-aminoalkyl-3-aminopropyltrialkoxysilane,
N-(3-trialkoxysilylalkyl)alkylenediamine,
N-alkylaminoisoalkyltrialkoxysilane,
N-(aminoalkyl)aminoalkylalkyldialkoxysilane,
N-β-(aminoalkyl)-γ-aminoalkyltrialkoxysilane,
N-(γ-trialkoxysilylalkyl)dialkylenetriamine,
N-phenylaminoalkyltrialkoxysilane,
poly(aminoalkyl)alkyldialkoxysilane,
tris(3-trialkoxysilyl)alkyl isocyanurate,
ureidoalkyltrialkoxysilane and
vinyl acetoxysilane.

This preferably includes at least one silane and/or at least one corresponding silanol/siloxane/polysiloxane and/or added initially and selected from the group of or based on:

(3,4-epoxybutyl)triethoxysilane,
(3,4-epoxybutyl)trimethoxysilane,
(3,4-epoxycyclohexyl)propyltriethoxysilane,
(3,4-epoxycyclohexyl)propyltrimethoxysilane,
3-acryloxypropyltriethoxysilane,
3-acryloxypropyltrimethoxysilane,
3-aminopropylsilanetriol,
3-glycidoxypropyltriethoxysilane,
3-glycidoxypropyltrimethoxysilane,
3-methacryloxypropyltriethoxysilane,
3-methacryloxypropyltrimethoxysilane,
3-(triethoxysilyl)propylsuccinic acid silane,
aminoethylaminopropylmethyldiethoxysilane,
ammethylaminopropylmethyldimethoxysilane,
aminopropyltrialkoxysilane,
β-(3,4-epoxycyclohexyl)ethyltriethoxysilane,
β-(3,4-epoxycyclohexyl)ethyltrimethoxysilane,
β-(3,4-epoxycyclohexyl)methyltriethoxysilane,
β-(3,4-epoxycyclohexyl)methyltrimethoxysilane,
bis-1,2-(triethoxysilyl)ethane,
bis-1,2-(trimethoxysilyl)ethane,
bis(triethoxysilylpropyl)amine,
bis(trimethoxysilylpropyl)amine,
γ-(3,4-epoxycyclohexyl)propyltriethoxysilane,
γ-(3,4-epoxycyclohexyl)propyltrimethoxysilane,
γ-acryloxypropyltriethoxysilane,
γ-acryloxypropyltrimethoxysilane,
γ-aminopropyltriethoxysilane,
γ-aminopropyltrimethoxysilane,
γ-methacryloxypropyltriethoxysilane,
γ-methacryloxypropyltrimethoxysilane,
γ-ureidopropyltrialkoxysilane,
N-2-aminoethyl-3-aminopropyltriethoxysilane,
N-2-aminoethyl-3-aminopropyltrimethoxysilane,
N-2-aminomethyl-3-aminopropyltriethoxysilane,
N-2-aminomethyl-3-aminopropyltrimethoxysilane,
N-(3-(trimethoxysilyl)propyl)ethylenediamine,
N-β-(aminoethyl)-γ-aminopropyltriethoxysilane,
N-β-(aminoethyl)-γ-aminopropyltrimethoxysilane,
N-(γ-triethoxysilylpropyl)diethylenetriamine,
N-(γ-trimethoxysilylpropyl)diethylenetriamine,
N-(γ-triethoxysilylpropyl)dimethylenetriamine,
N-(γ-trimethoxysilylpropyl)dimethylenetriamine,
poly(aminoalkyl)ethyldialkoxysilane,
poly(aminoalkyl)methyldialkoxysilane,
tris(3-(triethoxysilyl)propyl)isocyanurate,
tris(3-(trimethoxysilyl)propyl)isocyanurate,
ureidopropyltrialkoxysilane and
vinyl triacetoxysilane.

In individual embodiment variants, the aqueous composition optionally contains at least one silane/silanol/siloxane/polysiloxane with a group containing fluorine. The hydrophilicity/hydrophobicity may also be adjusted in a targeted manner, depending on the choice of the silane compound(s).

In many embodiments of the aqueous silane-based pretreatment composition, preferably at least one silane/silanol/siloxane/polysiloxane that is at least partially hydrolyzed, and an at least partially condensed silane/silanol/siloxane/polysiloxane is added to the aqueous silane-based pretreatment composition. In combining the aqueous composition in particular, at least one silane/silanol/siloxane/polysiloxane is preferably added. Such an additive is especially preferred.

In many embodiments at least one silane/silanol/siloxane/polysiloxane, which is at least largely and/or completely hydrolyzed and/or at least largely and/or completely condensed, may be added to the aqueous silane-based pretreatment composition. In many embodiment variants, a nonhydrolyzed silane does not bind as well to the metallic surface as does a silane/silanol that is at least partially hydrolyzed. A largely hydrolyzed silane/silanol/siloxane that has been condensed very little or not at all binds much better to the metallic surface in many embodiment variants than an at least partially hydrolyzed and largely condensed silane/silanol/siloxane/polysiloxane. A completely hydrolyzed and largely condensed silanol/siloxane/polysiloxane has only a low tendency to be bound chemically to the metallic surface in many embodiment variants.

In many embodiments, the aqueous silane-based pretreatment composition may contain at least one added silanol, which has multiple branching and/or three to 12 amino groups per molecule.

In many embodiments, at least one siloxane and/or polysiloxane which contains little or no silanes/silanols, e.g., less than 20% by weight or less than 40% by weight of the total of silane/silanol/siloxane/polysiloxane may be added to the aqueous silane-based pretreatment composition in addition and/or as an alternative to silane(s)/silanol(s). The siloxane and/or polysiloxane preferably has/have a short chain and is/are preferably applied by a Roll Coater treatment. This then affects the coating, optionally by greater hydrophobicity and higher corrosion protection on bare metal.

The aqueous silane-based pretreatment composition preferably contains at least two or even at least three compounds of titanium, hafnium and zirconium. These compounds may differ in their cations and/or in their anions. The aqueous composition, in particular the bath composition, preferably contains at least one complex fluoride b), especially preferably at least two complex fluorides selected from complex fluorides of titanium, hafnium and zirconium. Their difference preferably lies not only in the type of complex. The aqueous silane-based pretreatment composition, in particular the bath composition, preferably contains compounds b) selected from compounds of titanium, hafnium and zirconium in the range of 0.01 to 50 g/L, calculated as the sum of the corresponding metals. This content is especially preferably in the range of 0.05 to 30 g/L, most especially preferably in the range of 0.08 to 15 g/L, in particular in the range of 0.1 to 5 g/L.

The aqueous silane-based pretreatment composition preferably contains at least one complex fluoride, where the complex fluoride content is in particular in the range of 0.01 to 100 g/L, calculated as the sum of the corresponding metal complex fluorides as $MeF_6$. The content is preferably in the range of 0.03 to 70 g/L, especially preferably in the range of 0.06 to 40 g/L, most especially preferably in the range of 1 to 10 g/L. The complex fluoride may in particular be in the form of $MeF_4$ and/or $MeF_6$ but it also may be in other stages and/or intermediate stages. In many embodiment variants, there is advantageously at least one titanium complex fluoride and at least one zirconium complex fluoride present at the same time. In many cases, it may be advantageous to have at the same time at least one $MeF_4$ complex and at least $MeF_6$ complex in the composition, in particular one $TIF_6$ and one $ZrF_4$ complex at the same time. It may be advantageous here to adjust these complex fluoride relationships already in the concentrate and to transfer them to the bath in this way.

The individual complex fluorides surprisingly do not have a negative influence on each other when combined but instead manifest an unexpected positive enhancing effect. These additives based on complex fluoride evidently act in a similar or identical manner. If a combination of complex fluorides based on titanium and zirconium is used instead of just one complex fluoride based on titanium or one complex fluoride based on zirconium, this surprisingly always yields significantly better results than those achieved with a single one of these additives. On the surface, a complex fluoride based on titanium and/or zirconium would presumably be out of the question as an oxide and/or hydroxide.

It has surprisingly been found that a good multimetal treatment with a single aqueous composition is possible only when using a complex fluoride, and a very good multimetal treatment with a single aqueous composition is possible only when at least two different complex fluorides are used, for example, those based on titanium and zirconium. The individual complex fluorides used in a wide variety of experiments never yielded results that were equally good for the combination of these two complex fluorides, regardless of which additives were added in addition.

As an alternative or in addition to at least one complex fluoride, a different type of compound of titanium, hafnium and zirconium may also be added, for example, at least one hydroxycarbonate and/or at least one other water-soluble or weakly water-soluble compound, such as at least one nitrate and/or at least one carboxylate, for example.

Preferably only species of cations and/or corresponding compounds selected from the following group are used as the cations and/or the corresponding compounds c): aluminum, barium, magnesium, calcium, indium, yttrium, lanthanum, cerium, vanadium, niobium, tantalum, molybdenum, tungsten, lead, manganese, iron, cobalt, nickel, copper, silver, bismuth, tin and zinc, especially preferably from the group of aluminum, magnesium, calcium, yttrium, lanthanum, cerium, vanadium, molybdenum, tungsten, manganese, iron, cobalt, copper, bismuth, tin and zinc, not to mention trace amounts of less than 0.005 g/L in the bath composition, except for copper and silver, calculated as metal. Most especially preferred as cations and/or corresponding compounds c) are only species of cations and/or corresponding compounds selected from the group of magnesium, calcium, yttrium, lanthanum, cerium, manganese, iron, cobalt, copper, tin and zinc are selected from the group of calcium, yttrium, manganese, iron, cobalt, copper, tin and zinc, apart from trace contents of less than 0.005 g/L each in the bath composition, except for copper and silver, calculated as metal. Individual ones of these cations and/or compounds may also be preferred to increase the conductivity of the respective coating and/or an interface, to improve the binding to a coating and/or to use similar cations in the aqueous silane-based pretreatment composition, in at least one water rinse and/or in electrodeposition coating.

On the other hand, it has surprisingly been found that cations of iron and zinc and therefore also the presence of corresponding compounds in the bath, which may contribute to an increased extent to the dissolving of such ions out of the metal surface, especially with acidic compositions, do not have negative effects on the bath performance, the formation of layers and the layer properties over wide ranges of content.

The aqueous silane-based pretreatment composition, in particular the bath composition, preferably has a cation content and/or a content of corresponding compounds c) in the range of 0.01 to 20 g/L, calculated as the sum of the metals. It is especially preferably in the range of 0.03 to 15 g/L, most especially preferably in the range of 0.06 to 10 g/L, in particular in the range of 0.1 to 6 g/L. The amount of each individual type of cation and/or compounds c) in the aqueous silane-based pretreated composition is most especially preferably in the range of 0.005 to 0.500 g/L, from 0.008 to 0.100 g/L or from 0.012 to 0.050 g/L, calculated as metal, not including copper and silver cation contents, which may have a definite influence even in smaller amounts such as 0.001 to 0.030 g/L, where 1 ppm corresponds to 0.001 g/L. Depending on the type of cation and/or the corresponding compound, the preferred contents in the aqueous silane-based pretreatment composition are of a different order of magnitude.

The aqueous silane-based pretreatment composition preferably contains at least one type of cation selected from cations of cerium, chromium, iron, calcium, cobalt, copper, magnesium, manganese, molybdenum, nickel, niobium, tantalum, yttrium, zinc, tin and other lanthanides and/or at least one corresponding compound. In many embodiments, at least two, at least three or at least four different types of cations are added or at least three, at least four or at least five different types of cations are found in the aqueous silane-based pretreatment composition. Combinations of cations and/or their compounds selected from group 1) of cations of aluminum, iron, cobalt, copper, manganese, tin and zinc, 2) of cations of cerium, iron, calcium, magnesium, manganese, yttrium, zinc and tin, 3) of cations of copper, manganese and zinc or 4) of cations of aluminum, iron, calcium, copper, magnesium, manganese and zinc are especially preferred. Preferably not all the cations contained in the aqueous composition are dissolved out of the metallic surface, not only by the aqueous composition but also at least partially or even largely added to the aqueous composition. A freshly prepared bath may therefore be free of certain cations and/or compounds, which are released and/or are formed only by reactions with metallic materials and/or reactions in the bath.

The addition of manganese ions and/or at least one manganese compound has surprisingly been found to be especially advantageous. Although evidently no manganese compound or almost no manganese compound is deposited on the metallic surface, this addition evidently promotes the deposition of silane/silanol/siloxane/polysiloxane and thus improves the properties of the coatings significantly. Adding magnesium ions and/or at least one magnesium compound has also been found to be unexpectedly advantageous because this additive promotes the deposition of titanium and/or zirconium compounds, presumably as the oxide and/or hydroxide, on the metallic surface, and thus greatly improves the properties of the coating. Combined addition of magnesium and manganese leads in part to a further improvement in the coatings. However, addition of copper ions in the range of 0.001 to 0.030 g/L has been found to have a significant influence. Addition of indium and/or tin has also proven especially suitable. At a higher calcium ion content, it is important to be sure that no destabilization of a complex fluoride occurs due to the formation of calcium fluoride.

The aqueous silane-based pretreatment composition preferably contains at least one type of cation and/or corresponding compounds selected from alkaline earth metal compounds in the range of 0.01 to 50 g/L, calculated as the corresponding compounds, especially preferably in the range of 0.03 to 35 g/L, most especially preferably in the range of 0.06 to 20 g/L, in particular in the range of 0.1 to 8 g/L or up to 1.5 g/L. The alkaline earth metal ions and/or corresponding compounds may help to potentiate the deposition of compounds based on titanium and/or zirconium, which is often advantageous in particular for increasing the corrosion resistance.

The aqueous silane-based pretreatment composition preferably contains an amount of at least one type of cation selected from cations of aluminum, iron, cobalt, magnesium, manganese, nickel, yttrium, tin, zinc and lanthanides and/or at least one corresponding compound c), in particular in the range of 0.01 to 20 g/L, calculated as the sum of the metals. It is especially preferably in the range of 0.03 to 15 g/L, most especially preferably in the range of 0.06 to 10 g/L, in particular in the range of 0.020 to 6 g/L, 0.040 to 1.5 g/L, 0.060 to 0.700 g/L or 0.080 to 0.400 g/L.

The composition preferably contains at least one organic compound d) selected from monomers, oligomers, polymers, copolymers and block copolymers, in particular at least one compound based on acryl, epoxide and/or urethane. In addition or alternatively, at least one organic compound with at least one silyl group may also be used. In many embodiments, it is preferable to use such organic compounds with a content or even a higher content of OH groups, amine groups, carboxylate groups, isocyanate groups and/or isocyanurate groups.

The aqueous silane-based pretreatment composition preferably contains at least one organic compound d) selected from monomers, oligomers, polymers, copolymers and block copolymers in the range of 0.01 to 200 g/L, calculated as the solid additive. The content is especially preferably in the range of 0.03 to 120 g/L, most especially preferably in the range of 0.06 to 60 g/L, in particular in the range of 0.1 to 20 g/L. In many embodiment variants, such organic compounds may help to make the formation of the coating more uniform. This compounds may contribute to the development of a more compact, denser, chemically more resistant and/or more water-resistant coating in comparison with coatings based on silane/silanol/siloxane/polysiloxane, etc. without these compounds. Depending on the choice of organic compound(s), the hydrophilicity/hydrophobicity may also be adjusted in a targeted manner. However, a strongly hydrophobic coating is problematical in many applications because of the required binding of water-based paints in particular. When using an additive of at least one organic compounds, a combination with compounds with a certain functionality has proven to be especially advantageous such as, for example, compounds based on amines/diamines/polyamines/urea/imines/diimines/polyimines and/or their derivatives, compounds based on capped isocyanates, isocyanurates and/or melamine compounds, in particular, compounds with carboxyl groups and/or hydroxyl groups, such as carboxylates, long-chain sugar-type compounds, e.g., (synthetic) starch, cellulose, saccharides, long-chain alcohols and/or their derivatives. Of the long-chain alcohols, in particular those with 4 to 20 carbon atoms are added such as a butanediol, a butyl glycol, a butyl diglycol, an ethylene glycol ether such as ethylene glycol monobutyl ether, ethylene glycol monoethyl ether, ethylene glycol monomethyl ether, ethyl glycol propyl ether, ethylene glycol hexyl ether, diethylene glycol methyl ether, diethylene glycol ethyl ether, diethylene glycol butyl ether, diethylene glycol hexyl ether or a propylene glycol ether such as propylene glycol monomethyl ether, dipropylene glycol monomethyl ether, tripropylene glycol monomethyl ether, propylene glycol monobutyl ether, dipropylene glycol monobutyl ether, tripropylene glycol monobutyl ether, propylene glycol monopropyl ether, dipropylene glycol monopropyl ether, tripropylene glycol monopropyl ether, propylene glycol phenyl ether, trimethyl pentanediol diisobutyrate, a polytetrahydrofuran, a polyether polyol and/or a polyester polyol.

The weight-based ratio of compounds based on silane/silanol/siloxane/polysiloxane is calculated, based on the corresponding silanols, to compounds based on organic polymers, calculated as a solid additive in the composition, is preferably in the range of 1:0.05 to 1:30, especially preferably in the range of 1:0.1 to 1:2, most especially preferably in the range of 1:0.2 to 1:20. In many embodiment variants, this ratio is in the range of 1:0.25 to 1:12, in the range of 1:0.3 to 1:8 or in the range of 1:0.35 to 1:5.

It has surprisingly been found that addition of organic polymer and/or copolymer in particular greatly improves the corrosion resistance on iron and steel and is especially advantageous for a greater process reliability and consistently good coating properties.

The aqueous silane-based pretreatment composition optionally contains an amount of silicon-free compounds with at least one amino group, urea group and/or ureido group, in particular compounds of amine/diamine/polyamine/urea/imine/diimine/polyimine and derivatives therefore, preferably in the range of 0.01 to 30 g/L, calculated as the sum of the corresponding compounds. The amount is especially preferably in the range of 0.03 to 22 g/L, most especially preferably in the range of 0.06 to 15 g/L, in particular in the range of 0.1 to 10 g/L. Preferably at least one compound, e.g., aminoguanidine, monoethanolamine, triethanolamine and/or a branched urea derivative with an alkyl radical is added. An additive to aminoguanidine in particular substantially improves the properties of the coatings according to the invention.

The aqueous silane-based pretreatment composition optionally contains an amount of anions of nitrite and compounds with a nitro group, preferably in the range of 0.01 to 10 g/L, calculated as the sum of the corresponding compounds. The amount is especially preferably in the range of 0.02 to 7.5 g/L, most especially preferably in the range of 0.03 to 5 g/L, in particular in the range of 0.05 to 1 g/L. This substance is preferably added as nitrous acid $HNO_2$, as an alkali nitrite, as ammonium nitrite, as nitroguanidine and/or as paranitrotoluene sulfonic acid, in particular as sodium nitrite and/or nitroguanidine.

It has surprisingly been found that addition of nitroguanidine in particular to the aqueous silane-based pretreatment composition perceptibly improves the appearance of the coatings according to the invention, making them appear to be very uniform, and perceptibly increases the quality of the coating. This has a very positive effect in particular on "sensitive" metallic surfaces, such as sandblasted iron and/ or steel surfaces. Addition of nitroguanidine significantly improves the properties of the coatings according to the invention.

It has surprisingly been found that addition of nitrite can significantly reduce the tendency of iron and steel surfaces in particular to rust.

The aqueous silane-based pretreatment composition optionally contains compounds based on peroxide, for example, hydrogen peroxide and/or at least one organic peroxide, preferably in the range of 0.005 to 5 g/L, calculated as $H_2O_2$. The amount is especially preferably in the range of 0.006 to 3 g/L, most especially preferably in the range of 0.008 to 2 g/L, in particular in the range of 0.01 to 1 g/L. In the presence of titanium, a titanium-peroxo complex, which turns the solution and/or dispersion orange is often formed in the bath. However, this color is typically not present in the coating because this complex is evidently not incorporated into the coating as such. The titanium content and/or peroxide content can therefore be estimated on the basis of the color of the bath. The substance is preferably added as hydrogen peroxide.

It has unexpectedly been found that addition of hydrogen peroxide to the aqueous silane-based pretreatment composition according to the invention improves the optical quality of the coated substrates.

The aqueous silane-based pretreatment composition optionally contains an amount of phosphorus-containing compounds preferably in the range of 0.01 to 20 g/L, calculated as the sum of the phosphorus-containing compounds. These compounds preferably contain phosphorus and oxygen, in particular as oxy anions and as the corresponding compounds. The content is especially preferably in the range of 0.05 to 18 g/L, most especially preferably in the range of 0.1 to 15 g/L, in particular in the range of 0.2 to 12 g/L. Preferably at least one orthophosphate, an oligomer and/or polymer phosphate and/or a phosphonate is added as substance $d_4$). The at least one orthophosphate and/or salts thereof and/or esters thereof may be, for example, at least one alkali phosphate, iron, manganese and/or zinc-containing orthophosphate and/or at least one of their salts and/or esters. Instead of or in addition to this, at least one metaphosphate, polyphosphate, pyrophosphate, triphosphate and/or salts thereof and/or esters thereof may be added. For example, at least one phosphonic acid, e.g., at least one alkyl diphosphonic acid and/or salts thereof and/or esters thereof may be added as the phosphonate. The phosphorus-containing compounds of this substance are not surfactants.

It has surprisingly been found that addition of orthophosphate to the aqueous silane-based pretreatment composition according to the invention greatly improves the quality of the coatings in particular on electrolytically galvanized substrates.

it has also surprisingly been found that addition of phosphonate to the aqueous silane-based pretreatment composition according to the invention significantly improves the corrosion resistance of aluminum-rich surfaces, especially in the CASS test values.

The aqueous silane-based pretreatment composition optionally contains at least one type of anions selected from carboxylates such as acetate, butyrate, citrate, formate, fumarate, glycolate, hydroxyacetate, lactate, laurate, maleate, malonate, oxalate, propionate, stearate, tartrate and/or at least one corresponding compound that is only partially dissociated or not at all.

The aqueous silane-based pretreatment composition optionally contains carboxylate anions and/or carboxylate compounds in the range of 0.01 to 30 g/L, calculated as the sum of the corresponding compounds. The content is especially preferably in the range of 0.05 to 15 g/L, most especially preferably in the range of 0.1 to 8 g/L, in particular in the range of 0.3 to 3 g/L. Especially preferably at least one citrate, lactate, oxalate and/or tartrate may be added as the carboxylate. The addition of at least one carboxylate may help to complex a cation and keep it in solution more easily, so that a higher bath stability and controllability of the bath can be achieved. It has surprisingly been found that binding of silane to the metallic surface can be facilitated and improved to some extent by a carboxylate content.

The aqueous silane-based pretreatment composition preferably also contains an amount of nitrate. It preferably contains nitrate in an amount in the range of 0.01 to 20 g/L, calculated as the sum of the corresponding compounds. The content is especially preferably in the range of 0.03 to 12 g/L, most especially preferably in the range of 0.06 to 8 g/L, in particular in the range of 0.1 to 5 g/L. Nitrate may help to make the coating formation more uniform on steel in particular. Nitrite may in some circumstances be converted to nitrate, but usually only partially. Nitrate may be added in particular as an alkali metal nitrate, ammonium nitrate, heavy metal nitrate, as nitric acid and/or corresponding organic compounds. The nitrate may significantly reduce the tendency to rust, in particular on steel and iron surfaces. The nitrate may optionally contribute toward the development of a defect-free coating and/or an extremely even coating, which may possibly be free of optically recognizable marks.

The aqueous silane-based pretreatment composition preferably contains an amount of at least one type of cation selected from alkali metal ions, ammonium ions and corresponding compounds in particular potassium and/or sodium ions and/or at least one corresponding compound.

The aqueous silane-based pretreatment composition optionally contains an amount of free fluoride in the range of 0.001 to 3 g/L, calculated as $F^-$. The amount is preferably in the range of 0.01 to 1 g/L, especially preferably in the range of 0.02 to 0.5 g/L, most especially preferably in the range of 0.1 g/L. It has been found that in many embodiment variants it is advantageous to have a low free fluoride content in the bath because then the bath can be stabilized in many embodiments. If the free fluoride content is too high, sometimes that may have a negative influence on the cation deposition rate. In addition, non-dissociated fluoride and/or fluoride not bound in a complex may also occur in the range of 0.001 to 0.3 g/L in many cases. Such an additive is preferably added in the form of hydrofluoric acid and/or the salts thereof.

The aqueous silane-based pretreatment composition preferably contains an amount of at least one fluoride-containing compound and/or fluoride anions, calculated as $F^-$, and without taking into account complex fluorides, in particular at least one fluoride of alkali fluoride(s), ammonium fluoride and/or hydrofluoric acid, especially preferably in the range of 0.001 to 12 g/L, most especially preferably in the range of 0.005 to 8 g/L, in particular in the range of 0.01 to 3 g/L. The fluoride ions and/or the corresponding compounds may help to control the deposition of the metal ions on the metallic surface, so that, for example, the deposition of the at least one zirconium compound may be increased or reduced as needed. The weight ratio of the sum of the complex fluorides, calculated as the sum of the respective metals, to the sum of the free fluorides, calculated as $F^-$ is preferably greater than 1:1, especially preferably greater than 3:1, most especially preferably greater than 5:1, especially preferably greater than 10:1.

With the method according to the invention, the aqueous silane-based pretreatment composition may contain at least one compound selected from alkoxides, carbonates, chelates, surfactants and additives, for example, biocides and/or foam suppressants.

Acetic acid, for example, may be added as a catalyst for hydrolysis of a silane. The pH of the bath may be blunted, i.e., for example, with ammonia/ammonium hydroxide, an alkali hydroxide and/or a compound based on an amine, such as monoethanolamine, for example, whereas the pH of the bath is preferably lowered using acetic acid, hydroxyacetic acid and/or nitric acid. These substances can influence the pH.

The amounts and/or additives listed above usually have a promoting effect in the aqueous silane-based pretreatment compositions according to the invention in that they help to further improve the good properties of the aqueous basic composition of components a), b) and solvent(s) according to the invention. These additives are usually used in the same way if only one titanium compound or only one zirconium compound or a combination of these is used. However, it has surprisingly been found that the combination of at least one titanium compound and at least one zirconium compound in particular as complex fluorides can significantly improve the properties of the coatings produced with them in particular. The various additives surprisingly act as in a modular system and make a significant contribution toward optimization of the respective coating. Especially when using a so-called multimetal mix, such as that often encountered in the pretreatment of vehicle bodies and in the treatment or pretreatment of various small parts of assembly parts, the aqueous silane-based pretreatment composition has proven very successful because it can be optimized with various additives specifically for the respective multimetal mix and its particulars and requirements.

In the method according to the invention, a mix of various metallic materials can be coated with the aqueous silane-based pretreatment composition, for example, in the case of vehicle bodies or various small parts. For example, substrates with metallic surfaces can be selected here from cast iron, steel, aluminum, aluminum alloys, magnesium alloys, zinc and zinc alloys in any mix can be coated simultaneously and/or in succession according to the invention, wherein the substrates may at least partially be coated metallically and/or at least partially may consist of at least one metallic material.

Inasmuch as at least one additional component and/or traces of additional substances are not present, the remainder to a total of 1000 g/L consists of water or water and at least one organic solvent such as ethanol, methanol, isopropanol and/or dimethylformamide (DMF). The organic solvent content in most embodiments is particularly low or even zero. Because of the hydrolysis of at least one silane that is present, at least one alcohol may be present in particular, for example, ethanol and/or methanol. In particular, preferably no organic solvent is added.

The aqueous silane-based pretreatment composition is preferably or essentially free of all types of particles or particles having an average diameter larger than 0.2 μm that may optionally be added, for example, based on oxides, e.g., $SiO_2$. Many compositions are also free of additives of organic monomers, oligomers, polymers, copolymers and/or block copolymers.

Only if the coatings produced with the aqueous silane-based pretreatment composition have been dried to a greater extent, for example, for 5 minutes at 80° C. PMT (peak metal temperature), for example, 25 minutes at 70° C. PMT or more, these coatings are usually insensitive to water because condensation of the silanes, silanols, siloxanes, polysiloxanes has advanced to a greater extent. The degree of drying, which is associated with condensation and leads to a rinse-fastness of the coating containing siloxane and/or polysiloxane, varies according to the phase, the coating and the type of rinse.

The applied siloxane/polysiloxane-containing coating is preferably applied freshly and/or is optionally not dried at all or is dried only slightly when rinsed. The coating is preferably rinsed within 20 seconds after being applied. Since the silane-containing aqueous composition preferably has a temperature in the range of 10 to 50° C. when applied, especially preferably in the range of 15 to 35° C., and since the object to be coated preferably has a temperature in the range of 10 to 50° C., especially preferably in the range of 15 to 35° C., these temperatures are usually not so high and are usually not so different that the wet film will dry rapidly.

The aqueous silane-based pretreatment composition preferably contains a small amount of or is free of or essentially free of larger amounts of the substances that cause water hardness, such as calcium, in amounts in excess of 1 g/L. The composition is preferably free or almost free of lead, cadmium, chromate, cobalt, nickel and/or other toxic heavy metals. Such substances are preferably not added intentionally, but at least one heavy metal may be dissolved out of a metallic surface, for example, it may be entrained from another bath and/or may occur as an impurity. The composition preferably contains a small amount of or is essentially or entirely free of bromide, chloride and iodide because these may contribute toward corrosion under some circumstances.

The layer thickness of the coatings produced with the aqueous silane-based pretreatment composition is preferably in the range of 0.005 to 0.3 μm, especially preferably in the range of 0.01 to 0.25 μm, most especially preferably in the range of 0.02 to 0.2 μm, often at approx. 0.04 μm, at approx. 0.06 μm, at approx. 0.08 μm, at approx. 0.1 μm, at approx. 0.12 μm, at approx. 0.14 μm, at approx. 0.16 μm or at approx. 0.18 μm. The coatings containing organic monomer, oligomer, polymer, copolymer and/or block copolymer are often somewhat thicker than those that are free or almost free thereof.

Preferably a coating with a layer weight in the range of 1 to 200 $mg/m^2$, based on the titanium and/or zirconium content, is preferably formed with the aqueous silane-based pretreatment composition. This layer weight is especially preferably in the range of 5 to 150 $mg/m^2$, most especially in the range of 8 to 120 $mg/m^2$, in particular approx. 10, approx. 20, approx. 30, approx. 40, approx. 50, approx. 60, approx. 70, approx. 80, approx. 90, approx. 100 or approx. 110 $mg/m^2$.

A coating with a layer weight in the range of 0.2 to 1000 $mg/m^2$, based only on siloxane/polysiloxane and calculated as the corresponding largely thoroughly condensed polysiloxane is preferably formed with the aqueous silane-based pretreatment composition. This layer weight is especially preferably in the range of 2 to 200 $mg/m^2$, most especially preferably in the range of 5 to 150 $mg/m^2$, in particular approx. 10, approx. 20, approx. 30, approx. 40, approx. 50, approx. 60, approx. 70, approx. 80, approx. 90, approx. 100, approx. 110, approx. 120, approx. 130 or approx. 140 $mg/m^2$.

It has surprisingly been found that the quality of the silane-based pretreatment coating and the composition of the water for rinsing after the silane pretreatment have a significant effect on the quality of the electrodeposition coating applied subsequently and to some extent even affect the layers of paint which follow.

In rinsing, preferably a liquid, particle-free fluid, in particular water or a solution is used as the fluid. The fluid is especially preferably water of city tap water quality, a pure water quality such as deionized water or a water quality containing at least one surfactant, for example. A surfactant can contribute toward a greater evenness of the wet film. The surfactant can be added to the water, which may also be an aqueous rinse solution, as a surfactant mixture, wherein preferably an aqueous solution containing at least one surfactant and optionally also containing at least one additive, e.g., at least one solubilizer, at least one surface-active substance such as a phosphonate, at least one substance which influences the electrodeposition coating and/or the electrodeposition paint may be used. Evidently basically any surfactant may be added as the surfactant, but nonionic surfactants in particular, such as fatty alcohol glycol ethers, are preferred. It is advantageous to select low-foaming surfactants or those that cause little or almost no foaming and/or surfactant-containing mixtures for applications which may easily result in foam production as in after-rinsing by spraying. These mixtures may additionally contain a foam suppressant, for example, and/or a solubilizer and may have a low, very low or almost no tendency to foaming, either individually or in combination in spray processes, for example. The at least one surfactant here may fundamentally be selected from the group of anionic, cationic, nonionic, amphoteric and other surfactants, for example, low-foam block copolymers. It may be advantageous, for example, to use a combination of at least two surfactants or at least three surfactants. A combination of surfactants from different surfactant classes may be selected here, for example, one or two nonionic surfactants together with a cationic surfactant. Especially preferably at least two chemically different surfactants are selected from the nonionic surfactants. On the one hand, a combination of at least one surfactant per class selected from the classes of anionic, cationic, nonionic, amphoteric and other surfactants is especially preferred, in particular a combination of at least one nonionic surfactant with at least one surfactant from another surfactant class. On the other hand, it is also possible to use only nonionic surfactants in combination. The nonionic surfactants are advantageously selected from linear ethoxylates and/or propoxylates and preferably those with alkyl groups of 8 to 18 carbon atoms. If surfactants with a turbidity point are used, i.e., surfactants of a nonionic type, it is advantageous that these surfactants are no longer present in dissolved form in the washing medium of the washing process above the turbidity point in order to minimize the foaming, in particular when spraying. A mixture of an ethoxylated alkylamine together with at least one ethoxylated or ethoxylated and propoxylated alkyl alcohol may be especially advantageous for adjusting a low-foaming tendency. In particular with a combination of surfactants, the wetting and foam-suppressant properties, such as beading of the rinse water and the low-foaming property can be optimized at the same time, but the properties of the electrodeposition coating such as the visual impression of the electrodeposition coating, for example, unevenness and streaks, uniformity of the layer thicknesses of the electrodeposition coating, improvement in the throwing power of the paint in electrodeposition coating, in particular on undercut locations of the substrate to be coated as well as preventing marks can be influenced surprisingly advantageously with a combination of surfactants at the same time. On the other hand, addition of at least one solubilizer, for example, cumene sulfonate or a glycol, in particular dipropylene glycol, a polyglycol, a polyacrylamide and/or a modified polyacrylamide, a biocide, a fungicide and/or an agent to adjust the pH, for example, an amine or an organic and/or inorganic acid may also be used in the rinse water. Therefore, in a preferred method, an additive to the rinse water is used when rinsing the silane-based pretreatment coating, such that the wetting and foam suppressant properties are improved at the same time through the combination of at least two different surfactants and optionally additional additives such as solubilizers. In the method according to the invention, an additive with a surfactant content is used in the rinse water, thereby having an advantageous influence on the properties of the electrodeposition paint and the electrodeposition coating. The electrodeposition coated substrates, whose aqueous silane-based pretreatment coating has been rinsed with water containing a surfactant, also displayed a significantly improved paint throwing power in comparison with electrodeposition coated substrates rinsed with water that did not contain a surfactant.

The surfactant content in the rinse water for the after-rinse following the silane-based pretreatment is preferably in the range of 0.001 to 1.6 g/L, especially preferably in the range of 0.01 to 1.0 g/L or 0.05 to 0.6 g/L.

The fluid (=water for rinsing) preferably has a temperature in the range of 10° C. to 50° C., especially preferably in the range of 15° C. to 35° C. The objects coated with the wet film may be wetted by dipping into a bath and into a liquid spray or film, by spraying, splashing or some similar form of wetting in the liquid film and/or jet of a rinsing ring. The liquid jet or film preferably does not strike the coating containing the silane/silanol/siloxane/polysiloxane at a pressure of more than 2 bar.

As an alternative to the process sequence proposed so far, which is also based on the process sequence of the following Table 1, it is possible, on the one hand, to perform a prerinse and/or a first silane coating with an aqueous composition before the silane-based pretreatment according to the invention, such that this composition contains at least one silane, at least one compound selected from fluoride-free compounds of titanium, hafnium, zirconium, aluminum and boron, at least one highly dilute alkaline solution, such as NaOH and/or at least one complex fluoride and/or, on the other hand, to perform a rinsing after the aqueous silane pretreatment with an aqueous composition that contains not only water and optionally at least one surfactant for making the wet film more uniform.

Basically any type of electrodeposition coating may be used as the electrodeposition paint in the method according to the invention. In individual embodiment variants, it may be advantageous to adjust the composition of the aqueous silane-based pretreatment and/or the composition of the water for rinsing after this pretreatment to the type of electrodeposition paint that is used, in particular with respect to the surfactant(s) used, which do not have an interfering effect on the electrodeposition paint and/or the electrodeposition coating.

The coatings produced using the aqueous silane-based pretreatment composition according to the invention and then with an electrodeposition paint may then also be coated as needed with at least one primer, lacquer, adhesive and/or lacquer-type organic composition, wherein optionally at least one of the additional coatings is cured by heating and/or irradiation.

Alternatively or in addition to the procedure with the aqueous rinse containing surfactant after the pretreatment with the silane-based composition, an aqueous treatment with an amount of at least one iron compound dissolved in water may be performed before the pretreatment with the silane-based composition. This composition is preferably alkaline, in particular in a pH range from 9 to 14. This composition may be an alkaline cleaning agent, for example, which is used in at least one process step and contains an amount of at least one iron compound in at least one process step. In another embodiment, however, this composition may also be free of many or all additives of a typical cleaning agent and may serve as an aqueous iron-containing rinse, for example, which may then be used before, during and/or after the cleaning steps. This composition may fundamentally be at a temperature of >0° C. and <100° C. at the time of its application to metallic surfaces; in particular as a cleaning agent composition, it may be at a temperature in the range of 32° C. to 78° C. and especially preferably in the range of 38° C. to 70° C. or in the range of 40° C. to 60° C. when applied to metallic surfaces. The at least one iron compound is preferably at least one $Fe^{2+}$ compound dissolved in water and/or at least one $Fe^{3+}$ dissolved in water. The total Fe content of the aqueous composition dissolved in water and the total Fe content of the aqueous composition are preferably in a range of 0.005 to 1 g/L. The amounts of $Fe^{2+}$ compound dissolved in water are especially preferably in the range of 0 to 0.5 g/L, and the amounts of $Fe^{3+}$ compound dissolved in water are preferably in the range of 0.003 to 0.5 g/L. The Fe compounds dissolved in water may be added in particular in the form of water-soluble salts such as, for example, sulfates and nitrates. The coating is preferably rinsed at least once with water after being cleaned, in particular at least once with tap water and at least once with deionized water.

The metallic substrates coated by the method according to the invention may be used in the automotive industry, for rail vehicles, in the aviation and space industries, in equipment design, in mechanical engineering, in the construction industry, in the furniture industry, for the production of crash barriers, lamps, profiles, linings or small parts, for the production of vehicle bodies or vehicle body parts, individual components, preassembled and/or connected elements preferably in the automotive or aviation industries, for the production of appliances or systems in particular household appliances, control systems, testing equipment or construction elements.

The existing installations for cleaning and phosphating vehicle bodies before painting often have the following process steps as listed in the middle column of Table 1. The right-hand column lists the process steps which have surprisingly been recommended for cleaning and silane coating of vehicle bodies in a shortened process sequence.

TABLE 1

Typical sequence of process steps in phosphating and/or recommended sequence in silane coating of the vehicle bodies

| | Phosphating | Silane coating |
|---|---|---|
| Alkaline cleaning 1 | heated | heated |
| Alkaline cleaning 2 | heated | heated |
| Rinse 1 | tap water | tap water |
| Rinse 2 | tap water | deionized water |
| Activating | very often, with Ti or Zn phosphate | (omitted) |
| Rinse 3 | optionally unless activated in advance | (omitted) |
| Pretreatment | phosphating, heated | silane coating |
| Rinse 4 | tap water | deionized water |

TABLE 1-continued

Typical sequence of process steps in phosphating and/or recommended sequence in silane coating of the vehicle bodies

| | Phosphating | Silane coating |
|---|---|---|
| Rinse 5 | deionized water | deionized water |
| After-rinse solution | optional | (omitted) |
| Rinse 6 | deionized water | (omitted) |
| Rinse ring | optional | (omitted) |

It has also surprisingly been found that it is not only possible to produce coatings with certain solutions that are based not only on silane, such that these coatings are not only adequately rinse-fast to water, even without great drying of the freshly prepared coating, but also have somewhat better layer properties than the comparable coatings that have been dried thoroughly. Evidently the silane-based coatings which have not been dried to a greater extent are more reactive than a paint or paint-type of composition, such as cathodic deposition paint, for example, to be more reactive and to thereby have adequate adhesion. It is therefore possible to omit the drying step, which has previously been considered essential, and also to omit the drying channel, which was more than 10 meters long in some cases.

Based on the trend in zinc-manganese-nickel phosphating of vehicle bodies, which has been under development for several decades, the current phosphate layers produced today are of an extremely high quality. Nevertheless contrary to expectation it has been possible to achieve the same high-quality coatings with the silane-based coatings. With the method according to the invention, it is surprisingly possible to perform the pretreatment of vehicle bodies using solutions based on silane with relatively small amounts of the aqueous compositions without any negative effect on the quality of the coatings. However, if definitely larger amounts of the components of the bath are selected, this raises costs, while the quality of the coatings produced with such a composition usually cannot be increased further.

With the method according to the invention, it is possible to reduce the pretreatment step from 3 to 5 minutes for phosphating to approx. 2 minutes for coating with silane-based coatings and to omit the heating to temperatures often in the range of 50 to 60° C. in the case of phosphating. However, if the temperature of the composition is lower, the bath temperature is preferably raised to temperatures in the range of 15 to 25° C.

With the method according to the invention, it is possible to perform the pretreatment of vehicle bodies not only in shorter installations but also in installations that can be operated much less expensively while also being substantially more environmentally acceptable because the amounts of sludge containing heavy metals that must be disposed of can be reduced to a minimum and because water can be circulated to a greater extent and because the water throughput can be greatly reduced. Therefore the consumption of chemicals as well as the expenditures in workup can be greatly reduced because less than 1% of the sludge quantity that has occurred in phosphating in the past, based on the metallic surface to be coated is obtained, so that the cost of disposal of chemical waste is greatly reduced.

Addition of manganese to the aqueous silane-based pretreatment composition has surprisingly proven to be especially advantageous. Although evidently little or no manganese compound is deposited on the metallic surface, this addition greatly promotes the deposition of silane/silanol/siloxane/polysiloxane on the metallic surface. When nitroguanidine was added, it was surprisingly found that the appearance of the coated plates was very uniform, in particular even on sensitive surfaces such as sandblasted iron and/or steel surfaces. Addition of nitrite unexpectedly resulted in a definite reduction in the tendency of steel substrates to rust. It has surprisingly been found that any addition which has a significant positive effect as defined in this patent application also has an additive effect in improving the coating according to the invention. By selecting several additives as in a modular system, the various properties of a multimetal system in particular can be further optimized.

It has surprisingly been found that a good multimetal treatment with a single aqueous composition is possible only if using a complex fluoride, and a very good multimetal treatment with a single aqueous silane-based pretreatment composition is possible only if at least two different complex fluorides are used such as those based on titanium and zirconium, for example. In a variety of experiments, the individual complex fluorides that were used never yielded results that were as good as those obtained with the combination of these two complex fluorides, regardless of which additives were additionally added.

It could not have been foreseen that such a great increase in the quality of aqueous silane-based pretreatment compositions is possible with the addition of silane/silanol/siloxane/polysiloxane additive. However, a definite increase in the quality level was surprisingly found in all experiments starting with aqueous compositions based on a silane and just one complex fluoride based on titanium or zirconium.

In addition, it was surprising that testing the paint adhesion, even on steel, yielded rock fall test grades of one or two when a composition containing at least one silane and at least one complex fluoride was applied by the method according to the invention. Steel was found to be the most problematical material for aqueous compositions based on a silane and just one complex fluoride based on titanium or zirconium, in particular with regard to corrosion resistance (see B5, for example).

Experience has shown that the CASS test is problematical with aluminum and aluminum alloys, but the results were much better than expected with the compositions according to the present invention.

EXAMPLES AND COMPARATIVE EXAMPLES

The examples (E) and the comparative examples (CE) according to the invention as described below are presented to illustrate the subject matter of the invention in greater detail.

According to Table 2, the aqueous bath compositions are prepared as mixtures using prehydrolyzed silanes. They each contain a silane and optionally also a small amount of at least one similar additional silane, and here again, for the sake of simplicity, when silane is mentioned, it is also understood to mean silane, silanol, siloxane and/or polysiloxane, and as a rule, this variety of compounds, to some extent similar compounds in even larger numbers, is also run through in the development of the coating, so that several similar compounds are frequently also present in the coating. The prehydrolysis may also last for several days at room temperature with vigorous stirring, depending on the silane, unless the silanes to be used are already present in prehydrolyzed form. To prehydrolyze the silane, the silane is added to water in excess and optionally catalyzed with acetic acid. Acetic acid was added in only a few individual embodiment variants merely to adjust the pH. In some embodiment variants, acetic acid is already present as the catalyst for hydrolysis. Ethanol is not added but it is formed by hydrolysis. The finished mixture is used as a freshly prepared mixture.

Then for each test, at least three sheets of cold-rolled steel (CRS) are cleaned on both sides with an aqueous alkaline cleaning agent and rinsed with process water and then afterwards with deionized water as well as sheets of aluminum alloy Al6O16 and/or hot-dip galvanized or electrolytically galvanized steel and/or Galvanneal® (ZnFe layer on steel) are brought in contact with the corresponding treatment fluid on both sides at 25° C. by spraying, dipping or Roll Coater treatment. Immediately thereafter, the sheets pretreated in this way are rinsed briefly with deionized water. The sheets from the comparative examples are then dried at 90° C. PMT and next painted by a cathodic automotive dip coating (CDC). However, after the aqueous silane-based pretreatment, the sheet metal in the examples according to the invention is rinsed and then immersed in the CDC bath immediately after rinsing. Next the sheets are provided with a complete commercial automotive paint coating (electro-dip coating, filler, top coat or clear coat; total thickness of the layer package including CDC approx. 105 μm) and tested for their corrosion resistance and paint adhesion. The compositions and properties of the treatment baths as well as the properties of the coatings are summarized in Table 2.

The organofunctional silane A is an amino-functional trialkoxysilane and has one amino group per molecule. Like all the silanes used here, it is present in the aqueous solution mostly or completely in hydrolyzed form. The organofunctional silane B has a terminal amino group and has one ureido group per molecule. The nonfunctional silane C is a bis-trialkoxysilane. The corresponding hydrolyzed molecule has up to 6 OH groups on two silicon atoms.

The complex fluorides of titanium and/or zirconium are used largely on the basis of an $MeF_x$ complex, for example, $MeF_6$ complex. Manganese and optionally small amounts of at least one additional cation that is not mentioned in the table are added as metallic manganese to the respective complex fluoride solution and dissolved therein. This solution is added to the aqueous composition. If no complex fluoride is used, then manganese nitrate is added. The silylated epoxy polymer contains a small amount of $OH^-$ and isocyanate groups and therefore 33333 can be cross-linked chemically even subsequently at temperatures above 100° C.

The silanes contained in the aqueous composition—concentrate and/or bath—are monomers, oligomers, polymers, copolymers and/or reaction products with additional components based on hydrolysis reactions, condensation reactions and/or additional reactions. The reactions take place mainly in solution, during drying and/or optionally during curing of the coating, in particular at temperatures above 70° C. All concentrates and baths have proven to be stable over a period of a week and do not undergo any changes or develop any precipitates. No ethanol was added. Any ethanol content in the compositions originates only from chemical reactions.

In most examples and comparative examples, the pH is adjusted, specific with ammonia in the presence of at least one complex fluoride or in other cases with an acid. All baths have a good quality of the solution and almost always good bah stability. There are no precipitates in the baths. After coating with the silane-containing solution, a brief rinsing is first performed once with deionized water in the examples according to the invention and in the comparative examples, immediately following the aqueous silane-based pretreatment. The freshly applied wet film could not be dried further because the samples were rinsed within 5 seconds after applying the silane-containing coating. Both the freshly coated substrate and the rinse water were at room temperature. Rinsing was necessary to prevent the entrainment of substances from the pretreatment solution into the downstream paint bath. The freshly rinsed coated substrate was then dipped immediately in the cathodic dip paint, so that no further drying could occur. However, the coated sheets of the comparative examples were dried for 5 minutes at 120° C. in the drying cabinet immediately after rinsing, but the examples according to the invention were coated immediately thereafter by immersion in a cathodic dip coating without intermediate drying.

The visual test of the coatings can be performed significantly only with the coatings on steel because of the interference colors and this allows an evaluation of the uniformity of the coating. The coatings without any complex fluoride content are extremely uneven. Coating with titanium and zirconium complex fluoride has surprisingly proven to be much more uniform than if only if one of these complex fluorides had been applied. Addition of nitroguanidine, nitrate or nitrite also improves uniformity of the coating. In some cases, the layer thickness would increase with the concentration of these substances.

TABLE 2

Compositions of baths in g/L based on solids contents, or in the case of silanes, based on the weight of the hydrolyzed silanes; residual content: water and in most cases a very small amount of ethanol; process data and properties of the coatings

| | Example/Comparative example | | | | | | | | | | | | | | | | | |
|---|---|---|---|---|---|---|---|---|---|---|---|---|---|---|---|---|---|---|
| | CE 1 | E 1 | CE 2 | E 2 | CE 3 | E 3 | CE 4 | E 4 | CE 5 | E 5 | CE 6 | E 6 | CE 7 | E 7 | CE 8 | E 8 | CE 9 | E 9 |
| Organo-functional silane A | 0.2 | 0.2 | 0.2 | 0.2 | 0.2 | 0.2 | 0.2 | 0.2 | 0.2 | 0.2 | 0.1 | 0.1 | 0.3 | 0.3 | 0.2 | 0.2 | 0.2 | 0.2 |
| $H_2TiF_6$ as Ti | — | — | 0.2 | 0.2 | — | — | 0.2 | 0.2 | 0.2 | 0.2 | 0.1 | 0.1 | 0.3 | 0.3 | 0.2 | 0.2 | 0.2 | 0.2 |
| $H_2ZrF_6$ as Zr | — | — | — | — | 0.2 | 0.2 | 0.2 | 0.2 | 0.2 | 0.2 | 0.1 | 0.1 | 0.3 | 0.3 | 0.4 | 0.4 | 0.2 | 0.2 |
| Mn | — | — | — | — | — | — | — | — | — | 0.3 | 0.3 | — | — | — | 0.3 | 0.3 | — | — |
| Silylated epoxy polymer | — | — | — | — | — | — | — | — | — | — | — | — | — | — | — | — | 1.0 | 1.0 |
| pH | 10.5 | 10.5 | 4 | 4 | 4 | 4 | 4 | 4 | 4 | 4 | 4 | 4 | 4 | 4 | 4 | 4 | 4 | 4 |
| Layer weight in mg/m$^2$ from silanol and metal | 10-20 | 10-20 | 20-50 | 20-50 | 20-50 | 20-50 | 20-50 | 20-50 | 20-60 | 20-60 | 10-40 | 10-40 | 30-80 | 30-80 | 30-80 | 30-80 | 50-100 | 50-100 |
| BMW cross-cut test: grade | | | | | | | | | | | | | | | | | | |
| Steel | 4 | 3 | 5 | 5 | 3 | 2 | 2 | 1 | 1 | 0 | 2 | 1 | 1 | 1 | 1 | 0 | 1 | 1 |
| E-zinc on steel | 3 | 3 | 4 | 3 | 4 | 3 | 1-2 | 1 | 1 | 0 | 1 | 1 | 1 | 1 | 1 | 1 | 0 | 0 |
| Galvanized zinc on steel | 2 | 2 | 4 | 3 | 4 | 3 | 1 | 0 | 0 | 0 | 1 | 0 | 0-1 | 0-1 | 0-1 | 0 | 0 | 0 |
| Al 6016 | 2 | 2 | 2 | 2 | 2 | 2 | 1 | 1 | 1 | 0 | 2 | 1 | 1 | 1 | 1 | 0 | 1 | 1 |
| Galvanneal ® | 1 | 1 | 1 | 1 | 2 | 1 | 1 | 0 | 1 | 0 | 1 | 0 | 0 | 0 | 0 | 0 | 0 | 0 |
| Ten cycles of VDA mm, migration beneath coating: | | | | | | | | | | | | | | | | | | |
| Steel | 8 | 6 | 7 | 5 | 4 | 3 | 3 | 2.5 | 2 | 1 | 3.5 | 2 | 1.5 | 1.5 | 1.5 | <1 | 2.5 | 2 |
| E-zinc on steel | 5 | 4 | 3 | 2.5 | 4 | 4 | 2 | 1 | 1 | <1 | 3 | 1.5 | 1.5 | 1 | 1 | <1 | 1 | <1 |
| Galvanized zinc on steel | 4 | 4 | 2.5 | 2 | 3.5 | 3 | <1 | <1 | <1 | <1 | 1.5 | 1 | 1 | 1 | 1 | <1 | <1 | <1 |
| Galvanneal ® | 2 | 2 | 2 | 1 | 1.5 | 1.5 | <1 | 0 | <1 | <1 | 1 | 1 | <1 | <1 | <1 | <1 | 0 | 0 |
| Rock fall according to VDA loading, grade | | | | | | | | | | | | | | | | | | |
| Steel | 5 | 5 | 4 | 4 | 4 | 3 | 2-3 | 1 | 1 | 1 | 2 | 2 | 2 | 1 | 1-2 | 1 | 1 | 0-1 |
| E-zinc on steel | 5 | 4 | 3 | 2 | 4 | 3 | 2 | 1 | 1 | 1 | 2 | 1 | 1-2 | 0 | 1 | 0 | 1 | 0-1 |
| Galvanized zinc on steel | 5 | 4 | 3 | 2 | 4 | 3 | 1 | 0 | 1 | 0 | 1 | 1 | 1 | 0 | 1 | 0 | 0 | 0 |
| Galvanneal ® | 4 | 4 | 2 | 2 | 3 | 2 | 1-2 | 0 | 1 | 0 | 1 | 0-1 | 0 | 0 | 0 | 0 | 0 | 0 |
| Salt spray test 1008 hours: | | | | | | | | | | | | | | | | | | |
| Steel | 7 | 6 | 4 | 4 | 3.5 | 3 | 2 | 1.5 | 1.5 | <1 | 2.5 | 2 | 1.5 | <1 | 1.5 | <1 | 1 | 1 |
| CASS test mm migration | | | | | | | | | | | | | | | | | | |
| Al 6016 | 6 | 6 | 3.5 | 3 | 3.5 | 3 | 2.5 | 2.5 | 1.5 | 1 | 2.5 | 2 | 1.5 | 1 | 1.5 | 1 | 1.5 | 1 |

E = Example;
CE = Comparative example

If the various metallic surfaces that were coated are considered as a whole, all the examples show a significant improvement in the properties of the aqueous silane-based composition in comparison with the respective comparative example, wherein the same bath composition was applied in one case with subsequent drying (as comparative example CE) and in one case without subsequent drying (as example E according to the invention). The examples presented here are then examples according to the invention if they are utilized with this composition over the entire process sequence up to electro-dip coating on components using wrap-around.

It was surprising that this improvement, which actually brings only a limited improvement, in particular in cases where the coating results are already good, is systematically improved by not drying after application of the aqueous composition. Therefore, by omitting the drying, it is surprisingly possible to achieve a significant improvement, which is almost independent of the chemical composition of the aqueous bath. It was initially surprising that this improvement occurred with the solutions containing only silane as well as with the solutions containing silane and complex fluoride and/or optionally also manganese ions. It is therefore assumed that a similar steady improvement from drying to nondrying also occurs with solutions having a similar composition or with solutions based on silane or based on silane and complex fluoride and containing a few different substances. When more substances are present and when the low contents are higher, the corrosion resistance and paint adhesion may be better, as long as an optimum that might have occurred is not exceeded.

The layer weight varies not only according to the amounts of the individual components of the aqueous solution but also according to the type of the respective metallic surface which is coated. By selecting the bath components and their amounts, a very definite improvement in corrosion resistance and paint adhesion can thus be achieved on the whole.

The bath compositions all proved to be stables in the very short use time and could be applied well. There were no differences in behavior, in the visual impression or in the test results among the various examples and comparative examples that could be attributed to the treatment conditions, for example, application by spraying, dipping or roll coater treating. The resulting films are transparent and almost all of them are largely uniform. They do not show any pigmentation of the coating. The resulting films are transparent and almost all of them are largely uniform. The structure, gloss and color of the metallic surfaces appear to be only slightly altered by the coating. In the case of a titanium and/or zirconium complex fluoride content, iridescent layers are formed on steel surfaces in particular. The combination of several silanes has not yet resulted in any further significant improvement in corrosion protection in the experiment. However, this cannot be ruled out. In addition, an $H_3AlF_6$ content was found on aluminum-rich metallic surfaces due to corresponding reactions in the aqueous composition. However, the combination of two or three complex fluorides in the aqueous composition has surprisingly proven to be extraordinarily successful.

The layer thickness of the coating produced in this way—even depending on the method of application, which was initially varied in separate tests—is in the range of 0.01 to 0.16 μm, usually in the range of 0.02 to 0.12 μm, often as little as 0.08 μm, and it is definitely greater when an organic polymer was added.

Based on the development of zinc-manganese-nickel phosphating of vehicle bodies, which had been developed over a period of several decades, such phosphate layers produced today are of an extremely high quality. Nevertheless, contrary to expectation, it was also possible to achieve the same high-quality results even with the coatings containing silane, although greater efforts were necessary in this regard, even with the aqueous compositions containing silane that have been in use for only a few years.

The corrosion prevention grades in the cross-cut test according to DIN EN ISO 2409 after storage for 40 hours in 5% NaCl solution, corresponding to BMW specification GS 90011, were from 0 to 5, where 0 indicates the best value. In the salt spray condensed water alternating tests over 10 cycles according to the VDA test sheet 621-415 with a varying corrosion load between the salt spray test, the condensation water test and a drying pause, migration beneath the cut was measured on one side, starting from the scratch and reported in mm, where the under-migration was to be as low as possible. In the rock fall test according to DIN 55996-1, the coated sheets are bombarded with steel scrap following the VDA alternating load test for 10 cycles, as described above. The damage pattern is characterized by characteristic values from 0 to 5, where 0 indicates the best results. In the salt spray test according to DIN 50021 SS, the coated sheets were exposed to a corrosive sodium chloride solution by spraying for up to 1008 hours. Then the migration was measured in mm for the scratch, where the scratch was produced down to the metallic surface using a standardized gouge and where the migration beneath the film should be as minor as possible. In the CASS test according to DIN 50021 CASS, the coated sheets made of an aluminum alloy are exposed to a special corrosive atmosphere by spraying for 504 hours. Then the migration from the scratch is measured in mm and should be as small as possible.

Additional experiments on vehicle body elements have shown that the electrochemical conditions of the CDC bath could possibly be adapted slightly to the different type of coating but otherwise the excellent properties observed in the laboratory experiments on sheet metal can also be applied to vehicle body elements in an industrial environment.

The influence of additives on the spray water was investigated in additional experiments.

TABLE 3

Comparison of coating methods with and without the use of at least one surfactant and optionally additional additives in the rinse water to improve the electro-dip coating results

| | Example/Comparative example ("a" stands for the wet-wet process) | | | | | | | |
|---|---|---|---|---|---|---|---|---|
| | CE 10 | E 10 | CE 11 | E 11 | CE 12 | E 12 | E 13 | E 14 |
| Additives to the rinse water: | | | | | | | | |
| Total surfactant content in g/L | — | 0.2 | — | 0.2 | — | 0.2 | 0.2 | 0.2 + 0.2 |
| Added surfactant mixtures | — | A | — | A | — | A | B | A + B |
| Additional additives and content in g/L | — | — | 1) 0.1 | 1) 0.1 | 2) 0.005 | 2) 0.005 | — | — |
| Cross-cut after 240 hours in the KK test: grade | 5 | 2 | 3 | 2 | 1 | 1 | 0 | 0 |
| Salt spray test 1008 h in mm | 4.5 | 2.3 | 4.0 | 2.8 | 3.0 | 3.0 | 2.5 | 2.5 |
| Visual impression of the beading of the rinse fluid | good | good | good | good | good | good | very good | very good |
| Visual impression of the layer containing silane after rinsing | good | good | good | good | good | good | good | good |

TABLE 3-continued

| | | | | | | | | |
|---|---|---|---|---|---|---|---|---|
| Layer thickness CDC in μm | 43.7 | 41.9 | 40.3 | 38.3 | 39.8 | 38.4 | 37.7 | 37.5 |
| Layer thickness fluctuations of the CDC Δd in μm | 3.0 | 1.5 | 1.6 | 1.0 | 1.7 | 1.3 | 1.6 | 0.5 |
| Visual homogeneity of the CDC layer with respect to streaks | very heavy streaks | faint streaks | heavy streaks | faint streaks | heavy streaks | faint streaks | faint streaks | faint streaks |
| Visual: evenness of the CDC layer | very uneven | somewhat uneven | somewhat uneven | very uneven | somewhat uneven | somewhat uneven | almost even | almost even |

| | Examples/Comparative example | | | | |
|---|---|---|---|---|---|
| | CE 15 | E 15 | E 16 | E 17 | E 18 |
| Additives to the rinse water: | | | | | |
| Total surfactant content in g/L | — | 0.2 | 0.2 | 0.2 | 0.2 + 0.2 |
| Added surfactant mixtures | — | C | D | A | A + B |
| Visual impression of the flow of the rinse fluid | good | good | very good | good | very good |
| Visual impression of the layer containing silane after rinsing | good | good | good | good | Good |
| Visual: homogeneity of the CDC layer with respect to streaks | heavy streaks | faint streaks | faint streaks | faint streaks | faint streaks |
| Visually: evenness of the CDC layer | very uneven | somewhat uneven | somewhat uneven | somewhat uneven | almost even |
| Center layer thickness of CDC, outside, μm | 16 | 18 | 19 | 19 | 20 |
| Center layer thickness of CDC, inside, μm | 5 | 16 | 17 | 17 | 19 |
| Fluctuations in layer thickness of the CDC Δd in μm between the inside and the outside as a measure of throwing power | 11 | 2 | 2 | 2 | 1 |

E = Example
CE = Comparative example

All examples and comparative examples E 10 to E 18 and CE 10 to CE 12 as well as CE 15 to CE 18 were used in the wet-on-wet method with and without addition of a surfactant to the water after-rinse following the aqueous silane-based pretreatment and before immersion in the same electro-dip paint used for the manufacturing series. The compositions of the examples E 10 to E 18 and comparative examples and CE 10 to CE 12 and CE 15 to CE 18 were produced in the same way as the other examples and comparative examples and were used, except that only sheets of cold-rolled steel (CRS) were used in the second series and sheets of hot-dip galvanized steel were treated in the third series, and the sheets treated with the silane-containing composition were stored in room air at room temperature for 5 minutes to 30 minutes after rinsing before they were coated with a commercially available cathodic dip coating (electro-dip paint, e-coat, CDC) by immersing at 250 V (second series) or at 240 V (third series).

However, a slightly different type of cold-rolled steel was used than in the first series for the experiments according to Table 2 (=first series). For the examples E 10 to E 14 and comparative examples and CE 10 to CE 12 (second series), however, a different electro-dip paint was used than that used for examples E 15 to E 18 and comparative examples CE 15 to CE 18 (series 3). An electro-dip paint of generation 6, MC3 of PPG, was used for the latter. The layer thicknesses of the electro-dip paint were measured using the VDA method.

The half-hour waiting time simulates the cycle time of vehicle bodies coated in this way until the vehicle body is immersed in the CDC pool. The silane-containing coatings dry somewhat superficial here but not completely. The silane pretreatment of these examples and comparative examples is based on the compositions of example E 8 and comparative example CE 8, wherein aqueous silane-based pretreatment compositions, such as those in E 8 and CE 8, were used in the third series, except that they also contained 0.001 to 0.10 g/L Cu and 0.1 to 1 g/L Zn plus optionally also traces of Al and small amounts of Fe. The pH was also set at 4. The deionized water for the after-rinse was prepared with the addition of at least one surfactant in the examples according to the invention, where the surfactant or the surfactant mixture was added in the form of an aqueous solution. The surfactant mixture A contained a nonionic surfactant based on a fatty alcohol polyglycol ether. The surfactant mixture B contained a different type of nonionic surfactant and a solubilizer. The surfactant mixture B proved to be especially suitable for beading of the rinse water. The surfactant mixture C contained a nonionic surfactant based on an alkylamine. The surfactant mixture D contained a nonionic surfactant and a cationic surfactant. Additive 1) was a water-soluble diphosphonic acid with a longer alkyl chain. Additive 2) was a water-soluble tin compound.

All the CDC layers of a series were applied at the same voltage, even if this resulted in great differences in layer thickness. Fundamentally, the CDC layers of the second series were slightly too thick. The layer thicknesses were formed not only according to the electric conductivity of the pretreated substrate but apparently also to a great extent depended on the quality of the remaining pretreatment layer, which evidently differed in uniformity due to the different rinse compositions. The conditions were selected, so that inhomogeneities in the electro-dip paint were readily visible and a differentiation in the quality of the CDC layer was possible.

The additional investigations were performed on pretreated rinsed and CDC-coated sheet metal but they were different than in the first series of examples and comparative examples without the additional paint layers of a typical automotive paint structure: the corrosion resistance was determined in the salt spray test according to DIN EN ISO 9227 over a period of 1008 hours, and the paint adhesion was determined according to the cross-cut test method after a 240-hour constant climate test according to DIN EN ISO 6270-2 and according to DIN EN ISO 2409. In both test methods, the smaller values are better values.

On the one hand, a surprisingly strong correlation of the results with respect to corrosion resistance, paint adhesion CDC layer thickness and presumed homogeneity of the CDC layer as well as a great dependence of the results on rinsing with and without surfactant was revealed, wherein additives to the rinse water containing surfactant to some extent also yielded a further improvement. On the other hand, it was found that the homogeneity of the CDC layer is better, the smaller the resulting CDC layer thickness. Although the CDC layers of examples E 13 and E 14 were the thinnest in this series, these coated metal plates nevertheless had a much better corrosion resistance than the thicker CDC layers. The differentiation in quality with regard to paint adhesion is also surprisingly strong over the total possible range of grades from 5 to 0.

It has surprisingly been found that the quality of the silane-based pretreatment coating and the composition of the water for rinsing after the silane pretreatment had a substantial effect on the quality of the paint layers applied subsequently.

It was surprising that addition of at least one surfactant would have a strong effect on the subsequent coating with the electro-dip paint despite the comparatively low surfactant content in the rinse water and due to a very thin surfactant film which is even monomolecular under some conditions and is thereby produced and that the addition of at least one surfactant in the after-rinse would have strong effect on the interface between the silane pretreatment coating and the electro-dip coating as well as on the layer formation of the electro-dip coating. The electro-dip paints selected in the second and third series are of a particularly high quality and it is known that they can be processed especially uniformly.

Nevertheless, the unevenness in the electro-dip coating layer was so great in comparative example CE 11a that it must be assumed that marks would be visible up to the top coat in the subsequent coating with the paint layers that are typically used in automotive engineering. On the other hand, it has been observed in similar studies that clearly visible striations were formed in coating large-area vehicle body elements when they were rinsed without addition of a surfactant, but these striations could be prevented by adding a surfactant. A smoother CDC layer could be produced with the surfactant additive in the rinse liquid and would then in turn be partially responsible for the fact that even more uniform, smoother paint layers with fewer defects could be formed on the CDC layer. The throwing power of the paint in electro-dip coating was surprisingly also influenced to a great extent.

In the after-rinse following the silane pretreatment with water alone, inhomogeneities in the electro-dip paint that was subsequently applied or observed repeatedly despite the adequate in some cases repeated rerinsing and despite rerinsing at least once with deionized water.

In additional experiments not presented here in detail, it was also determined that fundamentally any surfactant can be added, wherein nonionic surfactants in particular are preferred, but it is necessary to select low-foaming surfactants or those with little or almost no foam production and/or surfactant-containing mixtures for rerinsing by spraying and these mixtures may additionally contain, for example, a foam suppressant and/or a solubilizer and may have a minor, very minor or almost no tendency to foam, for example, in spray processes when used individually or in any combination. The nonionic surfactants are advantageously selected from linear ethoxylates and/or propoxylates, preferably those with alkyl groups of 8 to 18 carbon atoms. The latter also includes the surfactants A, B and D. With such a combination of surfactants, the wetting and foam suppressing properties can be optimized at the same time but surprisingly a plurality of properties of the electro-dip paint and electro-dip coating have proven to be advantageously subject to influence by such a combination of surfactants.

On a zinc-rich metallic substrate in particular, the quality of the silane pretreatment and the type of after-rinse with water have a very strong effect on the homogeneity or inhomogeneity of the electro-dip coating (e-coat, CDC) and consequently also on the subsequent paint layer such as the base coat (filler as color medium) and the subsequent top coat (clear enamel). In the case of rinse water containing no added surfactant, it has been found that inhomogeneities in the electro-dip paint such as streaks are hardly avoidable. Streaks and other inhomogeneities as well as unevenness then subsequently easily and frequently lead to plastic marks in the following paint layers. Basically there should not be any plastic marks in the base coat or in the top coat of vehicle bodies for automobiles because these usually necessitate intense mechanical reworking and repainting. If the paint layers in reworking are removed too greatly, e.g., in reworking, for example, down to or even into the metallic substrate, then a pretreatment should also be applied before applying the first paint layer, for example, a pretreatment composition based on at least one silane or based on at least one silane with a titanium and/or zirconium compound and/or with an organic polymer. Such reworking not only causes problems in the work sequence but also causes substantial costs in particular due to the manual labor.

If at least one surfactant has been added to the rinse water and if the silane pretreatment has been processed well in the normal way, inhomogeneities were not observed anywhere in the electro-dip coating in any of the experiments and plastic marks were not found in any of the following paint layers. Plastic marks refer to inhomogeneities in the top paint layer, which are more or less distinctly visible to the naked eye due to height differences in the paint surface in particular. Only if the pretreatment composition itself was already extremely inhomogeneous were definitely inhomogeneous electro-dip coating layers formed even under extreme conditions after the after-rinse with rinse water containing surfactant and, following that, paint layers with only minor plastic markings were obtained.

The electro-dip-coated substrates whose aqueous silane-based pretreatment coating was rinsed with water containing a surfactant showed a definitely better paint throwing ability than the electro-dip-coated substrates rinsed with water that did not contain a surfactant.

Metallic components can be electro-dip coated with good results using the coating method according to the invention, even if problems had already occurred before the silane-based pretreatment, the water rinse contains no surfactant and no iron-containing treatment is performed before the silane-based pretreatment.

Alternatively or in addition to the procedure with the aqueous rinse containing surfactant, an aqueous treatment with an iron compound dissolved in water can be performed before the pretreatment with the silane-based composition.

In a new series of experiments, a further improvement in the application of the cathodic electro-dip paint to metallic surfaces containing zinc was found in examples 20 to 23 and in similar process variants in comparison with the procedures using a water rinse with or without a surfactant content. This improvement was achieved due to the fact that with an otherwise similar treatment sequence and similar treatment conditions as in the examples listed in Table 3, in which the electro-dip coating layer often has a 5 to 15% smaller layer thickness even when the temperature is constant and the voltage is kept constant. For cleaning the sheet metal prior to the silane-based pretreatment, a two-step cleaning process was utilized in which the sheet metal was first sprayed and then was dipped. When two content values are listed in Table 4, the content on the left is based on the spray process and the content on the right is based on the dipping operation if different contents were utilized. In this procedure the electro-dip coating layer was applied by using silane-based pretreatment compositions in comparison with zinc phosphate-based pretreatments with a lower voltage, so the throwing power of the electro-dip coating paint is also lower accordingly. It is therefore desirable to be able to use a voltage higher than 250 V, for example, without exceeding a layer thickness of the dried and baked electro-dip coating layer of 20 μm, for example. In these examples an ideal layer thickness of the dried and baked electro-dip enamel layer on the outside was obtained by using a voltage of approx. 250 V in electro-dip coating without employing the process steps according to the invention. The reduction in this layer thickness despite the use of a voltage of 250 V in electro-dip coating indicates the possibility of using a higher voltage which then also leads to a higher throwing power. The surfactant E added here is a nonionic surfactant based on an alkyl ethoxylate with one alkyl group and with end group capping in which a cationic compound was also added. The pH of the cleaning agent was in the range of 10 to 11. In cleaning in examples 20 to 23, a gluconate and/or a heptonate was added as a complexing agent in the total amount indicated there. Furthermore the cleaning agent contained at least one alkali compound which served to adjust the pH. Other variants that were not listed in detail in Table 4 relate to optional additional additives of boric acid or silicate as well as additional variation of all the cleaning agent ingredients, but all these process variants led to the same or similar results. In comparison with all these examples according to the invention, no cleaning step containing Fe was performed in comparative example 19, nor was there a rinse using a surfactant.

It has now been found that the use of an aqueous composition containing iron before application of the silane-based pretreatment composition permits an increased voltage in electro-dip coating for the production of a dried and backed electro-dip coating layer of 20 μm, for example. The voltage used here was often 5 to 15% higher, for example, 260 to 290 V. It was also found here that the throwing power achieved was also approx. 5% to 15% improved based on the increased voltage. Preliminary results also indicate improved paint adhesion and improved corrosion resistance for these variants according to the invention.

TABLE 4

Comparison of coating methods with and without Fe-containing additive in two-step cleaning and with and without the use of at least one surfactant in the rinse water to improve the electro-dip coating

| Addition in g/L (cleaning: left equal first spraying; right equal subsequent dipping) | Examples/Comparative example | | | | |
|---|---|---|---|---|---|
| | CE 19 | E 20 | E 21 | E 22 | E 23 |
| Additives in cleaning: | | | | | |
| Surfactant E + cationic compound | 2.0/3.0 | 2.0/3.0 | 2.0/3.0 | 2.0/3.0 | 5.0/8.0 |
| Water-soluble $Fe^{2+}$ compound | — | — | — | sulfate | — |
| Amount of $Fe^{2+}$ additive | 0 | 0 | 0 | 0.080 | 0 |
| Water-soluble $Fe^{3+}$ compound | — | nitrate | nitrate | nitrate | nitrate |
| Amount of $Fe^{3+}$ additive | 0 | 0.056/0.084 | 0.056/0.084 | 0.056/0.084 | 0.056/0.084 |
| Carboxylic acid(s) additive | 0 | 0.8/1.2 | 0.8/1.2 | 0.8/1.2 | 0.8/1.2 |
| Additives to rinse water: | | | | | |
| Total surfactant content in g/L | 0 | 0 | 0.2 | 0 | 0 |
| Surfactant added | — | — | E | — | — |
| Visual impression of the flow of rinse fluid on the silane-containing layer | good | Good | very good | good | good |
| Visual impression of the silane-containing layer after rinsing | good | Good | good | good | good |
| Visual: homogeneity of the CDC layer with respect to streaks | heavy streaks | faint streaks | faint streaks | faint streaks | faint streaks |
| Visual: evenness of the CDC layer | very uneven | slightly uneven | almost even | slightly uneven | slightly uneven |
| Average layer thickness of CDC on the outside, μm | 19.5 | 17 | 16 | 16 | 18 |
| Average layer thickness of CDC on the inside, μm | 7 | 15 | 14 | 14 | 17 |
| Fluctuations in layer thickness of the CDC, Δd in μm between the inside and the outside as a measure of throwing power | 12.5 | 2 | 2 | 2 | 1 |

E = Example

CE = Comparative example

The invention claimed is:

1. A method for improving the throwing power of an electrodeposition coating, the method comprising:

applying to a metallic surface two aqueous treatment compositions having different contents of at least one iron compound dissolved in water prior to contacting the metallic surface with an aqueous silane-based pretreatment composition;

contacting the metallic surface with the aqueous silane-based pretreatment composition that comprises:

a) at least one compound selected from silanes, silanols, siloxanes, and polysiloxanes, of which at least one of these compounds is still condensable, and b) at least one titanium, hafnium, and zirconium compound, and c) at least one type of cation selected from cations of metals of Groups IB to IIIB and VB to VIIIB, including lanthanides, and of main group II, of the periodic table of the elements, and/or at least one corresponding compound c), and/or d) at least one organic compound selected from monomers, oligomers, polymers, copolymers, and block copolymers, and e) water, and optionally at least one organic solvent and/or at least one substance to adjust the pH, thereby forming a pretreatment coating;

rinsing the pretreatment coating at least once with water optionally comprising a surfactant; and applying an electrodeposition coating after the rinsing, wherein the aqueous silane-based pretreatment composition has a pH of from 1.5 to 9, and wherein the pretreatment coating is not completely dried, so that the at least one compound a) is not highly condensed before the rinsing of the pretreatment coating with water and/or before the coating with the electrodeposition coating.

2. A method according to claim 1, further comprising applying an after-rinse solution following the application of the aqueous silane-based pretreatment composition to form a second conversion layer or a coating.

3. A method according to claim 1, wherein the aqueous silane-based pretreatment composition has a content of silane, silanol, siloxane, and polysiloxane in the range of 0.005 to 80 g/L, calculated on the basis of the corresponding silanols.

4. A method according to claim 1, wherein the aqueous silane-based pretreatment composition contains at least one silane, silanol, siloxane, and/or polysiloxane which contains at least one amino group, urea group, and/or ureido group.

5. A method according to claim 1, wherein the aqueous silane-based pretreatment composition has a content of compounds of b) selected from titanium, hafnium, and zirconium in the range of 0.01 to 50 g/L, calculated as the sum of the corresponding metals.

6. A method according to claim 5, wherein the aqueous silane-based pretreatment composition has at least one complex fluoride of titanium, hafnium, and/or zirconium.

7. A method according to claim 6, wherein the complex fluoride(s) of titanium, hafnium, and/or zirconium is in the range of 0.01 to 100 g/L, calculated as the sum of the corresponding metal complex fluorides calculated as $MeF_6$.

8. A method according to claim 1, wherein the at least one type of cation c) is selected from cations of aluminum, iron, calcium, cobalt, copper, magnesium, manganese, molybdenum, nickel, niobium, tantalum, yttrium, zinc, tin, cerium and other lanthanides.

9. A method according to claim 1, wherein in the aqueous silane-based pretreatment composition, only types of cations or corresponding compounds c) selected from the group of aluminum, magnesium, calcium, yttrium, lanthanum, cerium, manganese, iron, cobalt, copper, tin, and zinc, or selected from the group of aluminum, magnesium, calcium, yttrium, lanthanum, cerium, vanadium, molybdenum, tungsten, manganese, iron, cobalt, copper, bismuth, tin, and zinc are present.

10. A method according to claim 1, wherein the aqueous silane-based pretreatment composition has a cation content from compounds c) in the range of 0.01 to 20 g/L, calculated as the sum of the metals.

11. A method according to claim 1, wherein organic compounds d) have a content in the range of 0.01 to 200 g/L, calculated as the sum of the corresponding compounds.

12. A method according to claim 1, wherein a mix of various metallic materials is coated with the aqueous silane-based pretreatment composition simultaneously.

13. A method according to claim 1, wherein the aqueous silane-based pretreatment composition forms a coating having a layer weight which, based on titanium and/or zirconium, is in the range of 1 to 200 $mg/m^2$.

14. A method according to claim 1, wherein the coating formed from the aqueous silane-based pretreatment composition has a layer weight which, based only on siloxanes/polysiloxanes, is in the range of 0.2 to 1000 $mg/m^2$, calculated as the corresponding polysiloxane.

15. A method according to claim 1, wherein prior to applying the aqueous silane-based pretreatment coating, a prerinse and/or a first silane coating aqueous composition is performed, wherein the first silane coating aqueous composition contains at least one silane, at least one compound selected from fluoride-free compounds of titanium, hafnium, zirconium, aluminum, and boron, at least one alkaline solution, and/or at least one complex fluoride.

16. A method according to claim 1, wherein the rinse water has at least two different surfactants which in combination improve the wetting and foam suppressant properties.

17. A method according to claim 1, wherein at least one rinse with an aqueous composition contains at least one surfactant for homogenizing the wet film.

18. A method according to claim 1, further comprising applying, after the electrodeposition coating, at least one primer, paint, or adhesive, and/or a paint-like organic composition, to form at least one further coating.

19. A method according to claim 1, wherein each aqueous treatment composition having at least one iron compound dissolved in water also has at least one complexing agent.

20. A method according to claim 1 wherein each aqueous treatment composition having at least one iron compound dissolved in water has a pH of 9 to 14.

21. A method according to claim 1 wherein each aqueous treatment composition having at least one iron compound dissolved in water has a total iron content in the range of 0.005 to 1 g/L.

22. A method according to claim 1 wherein each aqueous treatment composition having at least one iron compound dissolved in water contains gluconate and/or heptonate.

* * * * *